US006849192B2

(12) United States Patent
Nakasaki

(10) Patent No.: US 6,849,192 B2
(45) Date of Patent: Feb. 1, 2005

(54) SURFACE TREATING METHOD

(75) Inventor: Yasushi Nakasaki, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 10/712,369

(22) Filed: Nov. 14, 2003

(65) Prior Publication Data

US 2004/0094508 A1 May 20, 2004

Related U.S. Application Data

(63) Continuation of application No. 09/672,018, filed on Sep. 29, 2000, now Pat. No. 6,689,284.

(30) Foreign Application Priority Data

Sep. 29, 1999 (JP) ..... 11-276260

(51) Int. Cl.[7] ..... B05D 7/24
(52) U.S. Cl. ..... 216/64; 134/37; 250/432 R
(58) Field of Search ..... 216/63, 64; 134/1, 134/1.3, 31; 250/432 R

(56) References Cited

U.S. PATENT DOCUMENTS 5,459,326 A * 10/1995 Yamada ..... 250/398
5,796,111 A * 8/1998 Mahoney ..... 250/492.2
6,413,583 B1 * 7/2002 Moghadam et al. ... 427/249.15

FOREIGN PATENT DOCUMENTS

JP 5-7869 1/1993
JP 10-137704 5/1998

OTHER PUBLICATIONS

Bach et al., "Nature of the Transition Structure for Oxygen Atom Transfer from a Hydroperoxide. Theoretical Comparison Between Water Oxide and Ammonia Oxide," J. Am. Chem. Soc., 113:6001–11 (1991).

* cited by examiner

*Primary Examiner*—Allan Olsen
(74) *Attorney, Agent, or Firm*—Finnegan, Henderson, Farabow, Garrett & Dunner, L.L.P.

(57) ABSTRACT

There is provided a method for surface treating where the environmental load is small. The surface treating method of the invention comprises that a cluster bonded by the first molecule and the second molecule by means of an intermolecular force is produced in a gas phase. At least a part of internal energy released in producing the cluster is utilized whereby the first molecule contained in the cluster is made in a state having higher reactivity than that of the first molecular not bonded with the second molecular. The surface of the member to be treated is treated in a gas phase with the cluster containing the first molecule made in a state of higher reactivity.

9 Claims, 12 Drawing Sheets

SURFACE TREATING METHOD

This is a continuation of application Ser. No. 09/672,018, filed Sep. 29, 2000 now U.S. Pat. No. 6,689,284, which is incorporated herein by reference.

FIELD OF THE INVENTION

The present invention relates to a surface treating method and, more particularly, to a surface treating method having little environmental load.

BACKGROUND OF THE INVENTION

In recent years, the regulatory environment in all aspects of Environment, Safety and Health (ESH) has been highlighted on a global scale. Incidentally, the term "regulatory environment" used here is essentially different from the more local problem of pollution generally, which is relatively local and on a scale such that it is within the earth's ability to self-clean, but still needs some countermeasures to assist it on a global scale.

In the semiconductor industry, environmental management is important as well, and at present, it is very important to reduce perfluorocarbon (PFC) emissions into the environment. In the semiconductor industry, however, the environmental problem is not only that just discussed above, but also that of reducing and recycling waste of acids and organic solvents, and reducing electric power consumption.

In a manufacturing process of semiconductor devices, cleaning up various types of contamination of semiconductor wafers has been carried out by a method where the wafer is dipped in an acidic or alkaline solution, such as a mixed solution of sulfuric acid/hydrogen peroxide, a mixed solution of hydrochloric acid/hydrogen peroxide, and a mixed solution of ammonia/hydrogen peroxide, followed by wafer heating or application of ultrasonic vibration. For example, removal of metal contamination adhered to the wafer surface is carried out by oxidation (ionization) of metal using sulfuric acid or the like, so that the contamination is eluted into a solvent to make into a solvated (hydrated) ion for stabilization.

However, when the waste from this type of cleaning treatment is made nontoxic, waste such as sludge is produced. In addition, there is a large amount of waste liquid produced by the above cleaning treatment and a large amount of electric power and water are necessary for waste treatment. Therefore, cleaning using sulfuric acid or the like has a very large environmental load.

Because of those reasons, it is preferred that water be used as a solvent for a solution for cleaning of wafers. It is also preferred to use a solution containing no elements other than H and O, such as pure water or a hydrogen peroxide solution, instead of an acidic or alkaline solution. Thus, for removal of metal contamination, it is ideal that metal is efficiently ionized using $H_2O$, $H_2O_2$ or the like, and is removed as a hydrated ion. For removal of organic contamination and particles, it is ideal that the organic substance is oxidized and decomposed using $H_2$ O, $H_2O_2$, or the like.

As such, the cleaning treatment using $H_2$o, $H_2O_2$, or the like is very effective from the viewpoint of waste management. On the contrary, however, a large amount of electric power is needed to purify the feed water. Therefore, there is a desire to reduce the amount of pure water used in the rinse processes. Thus, a dry cleaning technique has been pursued as a substitute for a conventional liquid phase cleaning technique.

Among the cleaning treatments of organic substances, removing resist material requires the largest amount of chemical solution. Furthermore, since it is a liquid phase heating treatment, electricity consumption is relatively high in addition to the already large load to air-conditioning equipment necessary for clean rooms. Therefore, various alternative processes have been studied and, as one of them, a process to remove resist material using aqueous ozone of high concentration has been investigated.

Since aqueous ozone consists of $O_3$ and $H_2O$ only, treatment with it is very effective to reduce the environmental load from the viewpoint of waste management. In this process, however, achieving a desired throughput is difficult, for the following reasons.

In a resist removing process using aqueous ozone, the resist removal rate is proportional to the concentration of ozone. Accordingly, in order to make the ozone concentration high for increasing the removal rate, it is necessary to lower the temperature of the aqueous ozone. However, when the temperature of the aqueous ozone is lowered, the reaction rate decreases. Therefore, in the above process, there is an upper limit for the resist removal rate.

In addition, the treatment using ozone has another problem. For example, ozone is explosively decomposed into oxygen and, therefore, it requires careful handling.

As to another cleaning technique utilizing the high oxidizing ability of aqueous ozone, a spin cleaning method of a single-wafer type can be used, where aqueous ozone and diluted hydrofluoric acid are alternately supplied to a wafer. In another method, hydrogen peroxide or ammonia is added to aqueous ozone and then an ultrasonic wave (of an MHz region), is applied to promote the production of OH radicals in the liquid. This cleaning treatment works by improving the oxidative ability of the liquid by the OH radical produced. However, in any of those methods, ozone is used and, therefore, the above-mentioned disadvantage is not yet overcome.

Regarding a cleaning method using no ozone, a method has been reported where an ultrasonic wave (of an MHz region) is applied to dissolved aqueous oxygen or dissolved aqueous hydrogen. This method also intends to improve the oxidative ability by promoting the production of OH radicals in the liquid. Since the dissolved aqueous oxygen and dissolved aqueous hydrogen used in this method are relatively safe, there is no need the same level of careful handling as that required in the case of using ozone. However, when dissolved aqueous oxygen is used, there is an upper limit for the dissolved oxygen concentration. In addition, when dissolved aqueous hydrogen is used, there is a disadvantage in that the hydrogen concentration margin for an optimum cleaning effect is narrow, owing to a competitive reaction between OH radical formation and OH radical deactivation by H radicals.

As a method for cleaning a semiconductor wafer, Japanese Patent Laid-Open Nos. 7869/1993 and 137704/1998 disclose a method using a highly functional cleaning solution prepared by applying microwaves to a chemical solution.

Japanese Patent Laid-Open 7869/1993 discloses a method whereby microwaves are used to irradiate pure water that is in contact with a catalyst consisting of palladium or platinum powder. Then pure water, where a wetting property becomes high, is supplied to a use point for cleaning. Although the microwave excitation lifetime of pure water in a liquid phase is not more than several milliseconds, however, the microwave-irradiated pure water in this method is supplied to the use point after passing through a pipe and then being filtered. Therefore, it is likely that the effect of microwave excitation is already lost at the use point.

In order to improve that, Japanese Patent Laid-Open No. 137704/1998 discloses a direct microwave irradiation application to the cleaning vessel. According to this method, the microwave irradiation excites pure water or a cleaning solution, and the molecular group constituting the pure water or cleaning solution is cleaved into a small size. As a result, surface tension of pure water and the cleaning agent solution at the wafer surface becomes lower, wetting increases, and radicals are generated. Therefore, a cleaning solution having a high chemical reactivity can be permeated into the inner side of the fine pores. In addition, since the liquid temperature can be raised uniformly and within a short time by an induced heating effect, a high reaction rate can be achieved. However, even in this method, a large amount of pure water is still consumed for the cleaning, and a large amount of electric power is needed for its production Environmental problems concerning the cleaning treatment of semiconductor wafers has been explained above and, as will be mentioned below, there are similar problems in other treatments as well.

For producing relatively thin silicon oxide films and metal oxide films used as gate insulating films or capacitors, or for etching a semiconductor film, metal film or insulating film, oxide species have been used that have a relatively strong oxidizing ability such as oxygen, ozone, di-nitrogen monoxide and nitrogen monoxide. Making a film thinner, and the line width smaller, will be more and more desirable in the future. In order to achieve that together with higher film quality (lower defect density), it is important that the oxidizing species are not supplied solely, but rather that both oxidants and reductants are simultaneously supplied to control the reaction rate. For example, in the case of carrying out the heating treatment of a wafer where metal such as tungsten is exposed, a method has been adopted where a partial pressure ratio of oxygen to steam is regulated so that oxidation of tungsten is prevented.

Usually, such treatments (except for etching) are carried out in a heat-treating furnace, such as an electric furnace or an infrared heating furnace. However, in the furnace, thermal efficiency is poor, consumption of electric power is high, and therefore there is a large environmental load.

Further, in every treatment, it is desired to avoid the use of gases that may cause atmospheric ozone layer depletion and/or global warming (e.g., gases having a large global warming potential (GWP)) as a supplying gas and an exhaust gas. The GWP is a product of the lifetime of the used gas in the atmosphere (which is mostly determined by the reaction rate with OH radicals) and the infrared absorption coefficient of said gas at the air window region (an infrared region of about 8–13 $\mu$m wavelength, except the infrared absorption band derived from $H_2O$). Thus, it is not recommended to use gases having an absorption band in the region, except for the infrared absorption band derived from $H_2O$, as a supplying gas and/or an exhaust gas.

As mentioned above, although cleaning with acid or alkali is effective for removing metal contamination, organic contamination, or particles, those methods need a waste liquid processing step having a large environmental load. In a cleaning method using aqueous ozone or a cleaning method using oxygen-dissolved water or hydrogen-dissolved water of which practical use has begun as an alternative cleaning method, solubility of such gases in water is several tens of ppm at best and, therefore, concentration of the resulting oxidizing species is limited by solubility. Therefore, it is difficult to achieve a sufficient throughput. In addition, in a liquid phase cleaning process, including a pure water rinse and a spin cleaning method of a single-wafer type, a large amount of pure water is used as a reaction species or solvent and, therefore, equipment for purifying the feed water on a large scale (with a large environmental load) is necessary. Thus, each and any of the above-mentioned surface treating methods does not have a small environmental load, and does not have a high treating ability.

SUMMARY OF THE INVENTION

The present invention has been accomplished in view of the above circumstances and its object is to provide a surface treating method having a small environmental load. Another object of the present invention is to provide a surface treating method whereby surface treating is made possible by a sufficient throughput. Still another object of the present invention is to provide a surface treating method whereby surface treating is possible without the use of a large amount of pure water.

In order to solve the above-mentioned problems, the present invention provides a surface treating method, for treating the surface of a member, comprising: producing a cluster having a first molecule and a second molecule bonded together by an intermolecular force in a gas phase, making the first molecule more reactive in a case where the first molecule is not bonded with the second molecule by using at least a part of internal energy released in producing the cluster; and treating the surface of the member in a gas phase with the cluster containing the first molecule made in a state of higher reactivity.

It is preferable that the first molecule and the second molecule are different.

It is preferable that the second molecule acts as a catalyst to make the first molecule have a higher reactivity.

It is preferable that the first molecule is a hydrogen peroxide molecule, while the second molecule is a water molecule.

It is preferable that the first molecule having higher reactivity contains oxywater.

It is preferable that the first molecule and the second molecule are supplied so that their molar ratio is made to be 1:3 near the surface of the member.

It is preferable that an electromagnetic field irradiates the cluster in producing the cluster.

It is preferable that the energy of the electromagnetic field is 0.4 eV or more.

Making the first molecule higher in reactivity near the surface of the member is preferable.

It is preferable that the first and the second molecules are supplied to the surface of the member, as follows: (1) as a gas diluting the first molecule and a gas diluting the second molecule, or (2) as a mixed gas diluting the first and the second molecules, and thereafter a microwave is applied to at least one of the gas diluting the first molecule, the gas diluting the second molecule, and the mixed gas.

It is preferable that the frequency of the microwave is 3 GHz or more.

It is preferable that at least one of the gas diluting the first molecule, the gas diluting the second molecule, and the mixed gas, are gases consisting of molecules having vibrational degrees of freedom of 60 or less.

It is preferable that treating the surface of the member with the cluster includes oxidizing the surface of the member or the contamination adhered to the surface of the member.

It is preferable to comprise further treating the surface of the member using any of a gas having reactivity with an oxide or a chelating agent forming a chelate compound with metal, after or together with treating the surface of the member with the cluster.

It is preferable to comprise further physically removing a residual product produced on the surface of the member by treating the surface of the member with the cluster.

It is preferable that treating the surface of the member with the cluster is at least one step selected from a group consisting of a step of cleaning the surface of the member, a step of forming a film on the surface of the member, and a step of etching the surface of the member.

It is preferable that the member is a semiconductor substrate, and treating the surface of the member with the cluster is at least one step selected from a group consisting of a step of cleaning the surface of the semiconductor substrate, a step of forming a silicon oxide film on the surface of the semiconductor substrate, a step of forming a metal oxide film on the surface of the semiconductor substrate, a step of forming a film by a chemical vapor phase deposition on the surface of the semiconductor substrate, a step of forming a film by a physical vapor phase deposition on the surface of the semiconductor substrate, a step of thermal treatment of the surface of the semiconductor substrate, and a step of dry etching of the surface of the semiconductor substrate.

The present invention provides a surface treating method for a substrate comprising: producing a cluster having a first molecule and a second molecule bonded together by intermolecular forces, wherein the first molecule has a higher reactivity than that of the first molecule when it is not bonded with the second molecule; and treating a surface of the substrate with an atmosphere of said cluster containing at least the first molecule having the higher reactivity.

It is preferred that the first molecule having higher reactivity contains oxywater.

The present invention provides a surface cleaning method for the surface of a member, comprising: producing a cluster having a hydrogen peroxide molecule and a water molecule bonded together by an intermolecular force in a vapor phase; and cleaning the surface of the member in a vapor phase with the cluster.

DETAILED DESCRIPTION OF THE INVENTION

Figure 1:
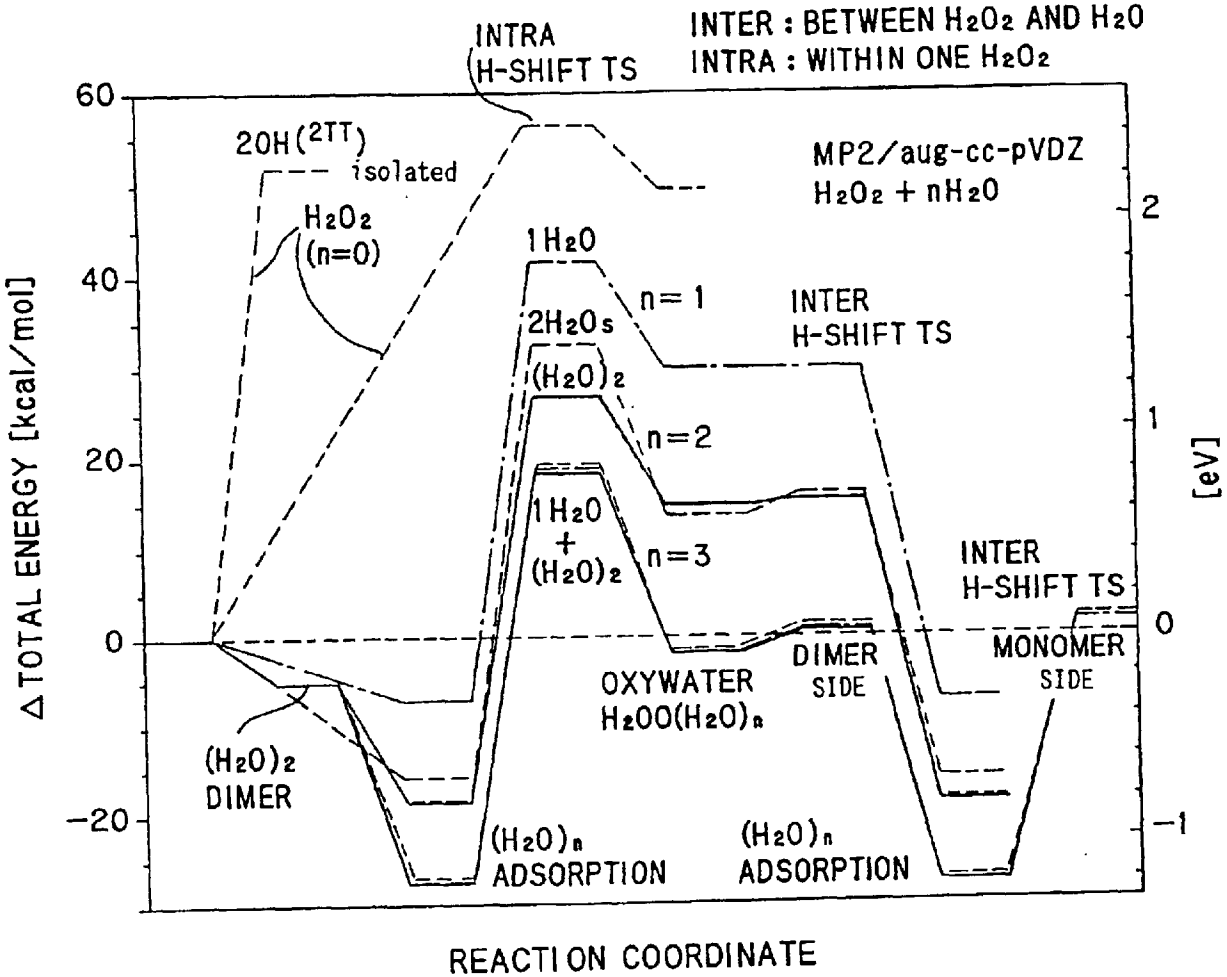
FIG. 1 is a graph showing the potential energy changes along the reaction paths of the production of $H_2OO$ from $H_2O_2$ in a gas phase.

The present invention provides a surface treating method wherein a cluster bonded by the first molecule to the second molecule by an intermolecular force is produced in a gas phase, and at least a part of the internal energy is released in producing the cluster makes the first molecule contained in the cluster more reactive, and the surface of the member is treated in a gas phase with the cluster containing the first molecule made in a state of higher reactivity.

The cluster means two or more molecules bonded together by an intermolecular force. It is preferable that the molecules number less than 50 from the viewpoint of the effect that one molecule is influenced by the molecules around the one molecule in a typical liquid phase.

A large amount of energy is usually necessary for making the first molecule, or that contained in the cluster consisting of the first molecule only, into a state of higher reactivity and, therefore, it is quite difficult to produce such reactive chemical species in high concentrations.

In the present invention, however, when the first molecule is made into a state of higher reactivity, a cluster is produced in which the first molecule and the second molecule are bonded by means of an intermolecular force. Such a cluster is stabilized by the amount of interaction energy of the first molecule with the second molecule. Further, in the present invention, internal energy released in producing the cluster is utilized for making the first molecule into a state of higher reactivity. According to the present invention, it is possible to make the first molecule higher in reactivity by merely providing very little energy to the cluster with no outside energy in an ideal manner.

An optimum state of the second molecule exists in order to make the first molecule higher reactivity. The energy to achieve the optimum state of the second molecule may be given to the cluster from outside the system. The energy given from outside the system depends upon the numbers of the molecules constituting the cluster, i.e. upon the structure of the cluster. Optimum cluster structure varies, depending upon the kind of the first and the second molecules, but when the liquid phase acts merely as a uniform dielectric media, a reaction barrier is not reduced effectively. Thus, in order to, make the first molecule higher in reactivity by a low activation energy, neither the liquid phase consisting of the first and the second molecules nor usual gas phase composed of just a mixture of the first and the second molecules is needed, but rather, to use a cluster comprising the first and the second molecules bonded by an intermolecular force to utilize the internal energy released in producing the cluster.

In the present invention, the first molecule and the second molecule may be the same kind of molecules or different kind of molecules. It is preferred that the second molecule acts as a catalyst so that the first molecule contained in the cluster is made to have a higher reactivity.

In the present invention, a hydrogen peroxide molecule may be used as the first molecule, and a water molecule may be used as the second molecule, for example. In that case, it is preferred that the reaction is controlled so as to form a cluster consisting of one molecule of hydrogen peroxide and three molecules of water. Endothermic energy to produce oxywater (or water oxide, $H_2OO$), consisting of an $H_2O_2$ molecule and three molecules of water from such monomers (i.e., an apparent reaction barrier), can be made nearly zero. In other words, it is possible that the total potential energy when those molecules are mutually positioned at infinity (i.e., the total potential energy of dissociation limit), and the total potential energy of the cluster consisting of three molecules of water and oxywater are made nearly the same. It is important that reducing the apparent reaction barrier is not attributed to the effect of local electric field due to the dielectric nature of hydrogen peroxide or water, but from intermolecular interaction itself between a hydrogen peroxide molecule and a water molecule. Accordingly, useful oxywater for various surface treating can be efficiently produced in a gas phase under controlled conditions.

In order to regulate the reaction so as to produce a cluster consisting of one molecule of hydrogen peroxide and three molecules of water, it may make the molar ratio of hydrogen peroxide to water about 1:3, not at the stage of introduction of the gases into a treating vessel, but on the surface of the member. In that case, it is preferable that the molar ratio of hydrogen peroxide to water vary from 1:2.5 to 1:3.5, more preferably from 1:2.75 to 1:3.25.

In that case, it is possible that the exothermic energy for producing a cluster consisting of oxywater and three molecules of water from those monomers is made nearly zero.

Incidentally, under the situation where intermolecular collisions are vigorous, the lifetime of oxywater is not so long. Therefore, it is preferred that production of oxywater is carried out near the member. Further, the apparent reduction in the reaction barrier for producing oxywater is measured from a dissociation limit. Therefore, when energy released in producing a cluster of hydrogen peroxide with water cannot be utilized for producing oxywater or, in other words, when the energy is lost by excitation of vibrational or rotational states due to collision of clusters, it is difficult to reduce the apparent reaction barrier. Accordingly, it is important to suppress the collisional relaxation and also to produce an oxidizing species near the surface of the member.

In order to prevent the undesired collisional relaxation, reaction of hydrogen peroxide with water should not be carried out in a bulk of liquid phase and vapor phase, but instead they may be separately supplied to the surface of the member. In that case, producing the oxidizing species near the surface of the member can also be done easily.

Also, in the case of using additional gases, it is same as described above. It is important to use additional gases with as small vibrational degrees of freedom as possible. It is preferred that the additional gases have vibrational degrees of freedom of 60 or less.

They may be also supplied to the surface of the member as a mixed gas of hydrogen peroxide with water. For example, it is possible that a cluster of hydrogen peroxide and water is prepared in a bulk of gas phase having a smaller density of three or more orders of magnitude as compared to a liquid phase, and the resulting cluster is supplied to the surface of the member together with suppressing the collisional relaxation. Incidentally, when hydrogen peroxide and water are supplied as a mixed gas to the surface of the member, it is preferred that the total gas pressure is one atmospheric pressure or lower.

In order to suppress undesired clustering of hydrogen peroxide and/or water and also to prepare a cluster of them in a desired size, microwave irradiation is effective. When microwaves irradiate hydrogen peroxide and water, their molecules are subjected to a rotational excitation and, therefore, a cluster of a desired size (cluster composed of desired numbers of molecules) can be selectively prepared.

For example, when microwaves of frequency 3.4 GHz or more are used to irradiate, an $H_2O$ cluster consisting of three or less molecules can be selectively supplied. When microwaves of frequency 3.2 GHz or more are used to irradiate, an $H_2O_2$ cluster that consists of two or less molecules can be selectively supplied. Accordingly, irradiation with microwaves of frequency 3 GHz or more is preferred, while irradiation with microwaves of frequency 3.2 GHz or more is more preferred, and furthermore, irradiation with microwaves of frequency 3.4 GHz is still more preferred.

The above-mentioned method of the present invention can be applied to various surface treating techniques using an oxidizing species. For example, in a fabrication process of semiconductor devices, it can be utilized for a cleaning treatment of a semiconductor substrate. It can be also utilized for the formation of various oxide films, such as silicon oxide films and metal oxide films, for the heating treatment after their formation and for a dry process requiring an oxidizing species, such as a dry etching process. The method of the present invention may also be applied not only to a process for the fabrication of semiconductor devices, but also to a process for the manufacture of other substances.

DESCRIPTION OF THE PREFERRED EMBODIMENTS

The present invention will now be illustrated in more detail. Incidentally, the following illustration will be made for the case where a hydrogen peroxide molecule and a water molecule are used as the first and the second molecules, respectively, although it will also be similar for the cases where other chemical substances are used.

As the temperature rises, pure water becomes acidic and, at the same time, its electric resistibility and viscosity coefficient are reduced. This is caused by an increase in degree of dissociation and by changes in the cluster structure of water. Changes in physical properties of pure water as such are also caused by such excitation methods other than a temperature rise, for example, such as electrolysis and application of microwaves, magnetic fields and ultrasonic waves, although their mechanism has not been so well clarified as of yet. The result of theoretical investigation by means of quantum chemistry on efficient production methods of oxidizing species (including by means of microwave irradiation) in a system containing pure water and hydrogen peroxide will be discussed below.

First, it was tested whether an $H_2O$ cluster and an $H_2O_2$ cluster consisting of a desired number of molecules can be selectively supplied by microwave irradiation. Thus, rotational constants of an $H_2O$ cluster and an $H_2O_2$ cluster were calculated, and the resonance condition for selecting the cluster of the desired size by microwave excitation was clarified. The results are shown in the following Table 1 and Table 2, respectively.

TABLE 1

| Rotational constants of $(H_2O)_n$ clusters at the MP2/aug-cc-pVDZ level of theory. [GHz] | | | | |
|---|---|---|---|---|
| n | structure | Bx | By | Bz |
| 1 | —[a)] | 796.05 | 433.51 | 280.67 |
| 2 | linear[a)] | 214.32 | 6.388 | 6.387 |
| 3 | cyclic[a)] | 6.842 | 6.770 | 3.466 |
| 4 | cyclic[a)] | 3.587 | 3.587 | 1.824 |
| 5 | cyclic[a)] | 2.030 | 2.019 | 1.033 |
| 6 | cage[b)] | 2.241 | 1.151 | 1.103 |
| 6 | prism[b)] | 1.697 | 1.417 | 1.358 |
| 6 | cyclic[b)] | 1.241 | 1.241 | 0.632 |
| 8 | box[b)] | 0.909 | 0.909 | 0.853 |

[a)]Geometry was optimized by analytic derivative method
[b)]Geometry was optimized by numerical derivative method

TABLE 2

| Rotational constants of $(H_2O_2)_n$ clusters at the MP2/aug-cc-pVDZ level of theory. [GHz] | | | | |
|---|---|---|---|---|
| n | structure | Bx | By | Bz |
| 1 | —[a)] | 296.37 | 25.88 | 25.06 |
| 2 | linear[a)] | 13.56 | 3.263 | 3.225 |

[a)]Geometry was optimized by analytic derivative method

Incidentally, it is easily presumed that the more the cluster size, the more the rotational moment, whereby the less the rotational constant. Accordingly, with regard to an $H_2O$ cluster, calculation was carried out up to the cluster size consisting of 8 molecules.

The $H_2O$ cluster can have various stable (local minimum) structures and, as will be clear from Table 1, the rotational constant tends to increase as the size of the cluster decreases. For example, it is noted that, in order to select a cluster consisting of four or less molecules, microwaves of about 3.4 GHz or more are used for irradiation. As to an $H_2O_2$ Cluster, a calculation was carried out up to the cluster consisting of two molecules only as shown in the Table 2 but, since the monomer per se has an O—O bond, whereby its rotational moment is larger than $H_2O$, it is noted that its rotational constant is very small as compared with an $H_2O$ cluster. For example, in selecting the cluster consisting of two or less molecules, it is noted that microwaves of about 3.2 GHz or more are used for irradiation.

Then, various decomposition processes of hydrogen peroxide were investigated. Incidentally, at this time, the changes in energy and structure of an isolated cluster consisting of one molecule of $H_2O_2$ and zero to three molecule (s) of $H_2O$ in vacuo were investigated along various reaction paths without taking the "solvent effect" by water in the bulk of liquid phase into consideration. A specific method for the calculation is as follows. The solvent effect will be considered later.

Changes in energy (potential energy surface, or PES) along the various reaction paths of the chemical reactions are represented by:

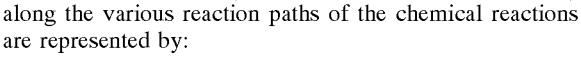

$$H_2O_2+nH_2O \rightarrow H_2OO \cdot nH_2O \quad (n\text{: an integer of 0–3})$$

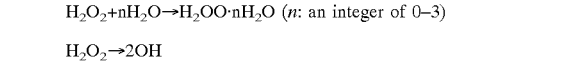

$$H_2O_2 \rightarrow 2OH$$

were calculated by a density functional method (BHandHLYP) and a second-order Møller-Plesset perturbation method (MP2) with a Hartree-Fock configuration as a reference space. The basis set employed is the augmented correlated set aug-cc-pVDZ, which is optimized for a post Hartree-Fock calculation.

Incidentally, the energy value given hereinafter is the value at the MP2/aug-cc-pVDZ level of theory unless otherwise mentioned. The energy value given hereinafter is that obtained by comparing the internal energy ("electronic" energy, or $E_{elec}$) only and does not include solvation energy ($E_{solv}$), kinetic energy, zero point vibrational energy (ZPE), vibrational/rotational/translational energies ($E_{vib}/E_{rot}/E_{trans}$), and an entropy term (S) ($E_0=E_{elec}+ZPE$; $E=E_0+E_{vib}+E_{rot}+E_{trans}$; H=E+RT; G=H−TS; where R is gas constant; T is absolute temperature).

The result of calculations concerning the system in which one molecule of $H_2O$ participates in the formation of oxywater from $H_2O_2$ was identical with that mentioned in the literature, such as *J. Am. Chem. Soc.*, vol. 113, (1991) 6001, etc. Regarding the system in which two molecules of $H_2O$ participate, the result was also same as that mentioned in the above literature when each of the two $H_2O$ molecules independently interacts with $H_2O_2$. However, when one takes into consideration the fact that $H_2O$ is apt to form an oligomer by a hydrogen bond, it is necessary to consider the hydrogen transfer of both intramolecular (within an $H_2O_2$ molecule) and intermolecular (between an $H_2O_2$ and an $H_2O$ molecule) paths when an $H_2O$ dimer comes close to an $H_2O_2$ molecule. As to the system where three $H_2O$ molecules participate, it is also necessary that the formation of an $H_2O$ oligomer be taken into consideration. Since those systems are not disclosed in the above-mentioned literature, they will be discussed herein.

First, PES, in which one to three molecule(s) of $H_2O$ participate, will be briefly mentioned. When one $H_2O$ molecule participates, it has been found that a reaction barrier of oxywater formation is lower, to an extent of not less than 10 kcal/mol via an intermolecular hydrogen transfer (a concerted 1,4-hydrogen shift) path than via an intramolecular hydrogen transfer (1,2-hydrogen shift) path. The former process does not take place in the case of one isolated $H_2O_2$ molecule, and shows a catalytic effect of an $H_2O$ molecule. When two molecules of $H_2O$ participate, it has been also found that, as compared with the intramolecular hydrogen transfer path, the barrier is lower in the intermolecular hydrogen transfer path, to an extent of not less than 10 kcal/mol.

It is particularly noteworthy that, when two molecules of $H_2O$ participate, although the reaction barrier in the reaction to produce $H_2OO$ from $H_2O$-adsorbed $H_2O_2$ is reduced to an extent of only about 4 kcal/mol, as compared with the case of participation of one molecule of $H_2O$ in both intramolecular and intermolecular hydrogen transfer paths, endothermic energy is remarkably decreased for forming $H_2OO$ measured from the dissociation limit of an $H_2O_2$ and two $H_2O$ molecules. Therefore, the analogous investigation was carried out for the case where three molecules of $H_2O$ participated, wherein the same tendency was observed and it has been noted that endothermic energy measured from the dissociation limit becomes nearly zero. Results obtained by the above calculations are shown by a graph and figures.

FIG. 1 is a graph showing the potential energy changes along the reaction paths of producing $H_2OO$ from $H_2O_2$ in a gas phase. Incidentally, changes in the structure along the reaction paths shown in FIG. 1 are shown in FIGS. 2 to 6. Table 3 summarizes the results for clarifying the relation between the energy changes and the number of $H_2O$ molecules.

TABLE 3

Reaction energies of $H_2O_2 + nH_2O \rightarrow H_2OO \cdot nH_2O$ (n = 0~3) systems at the MP2/aug-cc-pVDZ level of theory [kcal/mol].

| | $H_2O$ adsorption | activation energy 1,2 H-shift (intra) ($E_{a:1,2Ts}^{for}$) | stabilization energy after 1,2TS ($E_{a:1,2TS}^{rev}$) | activation energy 1,4 H-shift (inter) ($E_{a:1,4TS}^{rev}$) | stabilization energy after 1,4TS ($E_{a:1,4TS}^{rev}$) |
|---|---|---|---|---|---|
| n = 0 | — | 57.144 | 7.454 | — | — |
| n = 1 | 7.626 | 49.291 | 11.744 | 37.863 | 0.317 |
| n = 2 2-mono. | 16.018 | 48.559 | 19.385 | 31.512 | 2.338 |
| n = 2 1-di. | 18.205 | 45.319 | 13.041 | 33.133 | 0.856 |
| n = 2 1-di. | 18.589 | 45.578 | 12.778 | 33.639 | 0.838 |
| n = 2 1-di. | 18.589 | 46.389 | 12.859 | 34.686 | 1.158 |
| n = 3 di & mono. | 27.163 | 46.156 | 21.101 | 27.637 (d)<br>28.391 (m) | 2.582 (d)<br>3.336 (m) |
| n = 3 di & mono. | 27.567 | 45.943 | 20.761 | 27.858 (d)<br>28.507 (m) | 2.676 (d)<br>3.325 (m) |
| n = 3 di. & mono. | 26.709 | 46.100 | 20.902 | 28.268 (d)<br>28.509 (m) | 3.070 (d)<br>3.310 (m) |

Figure 2:
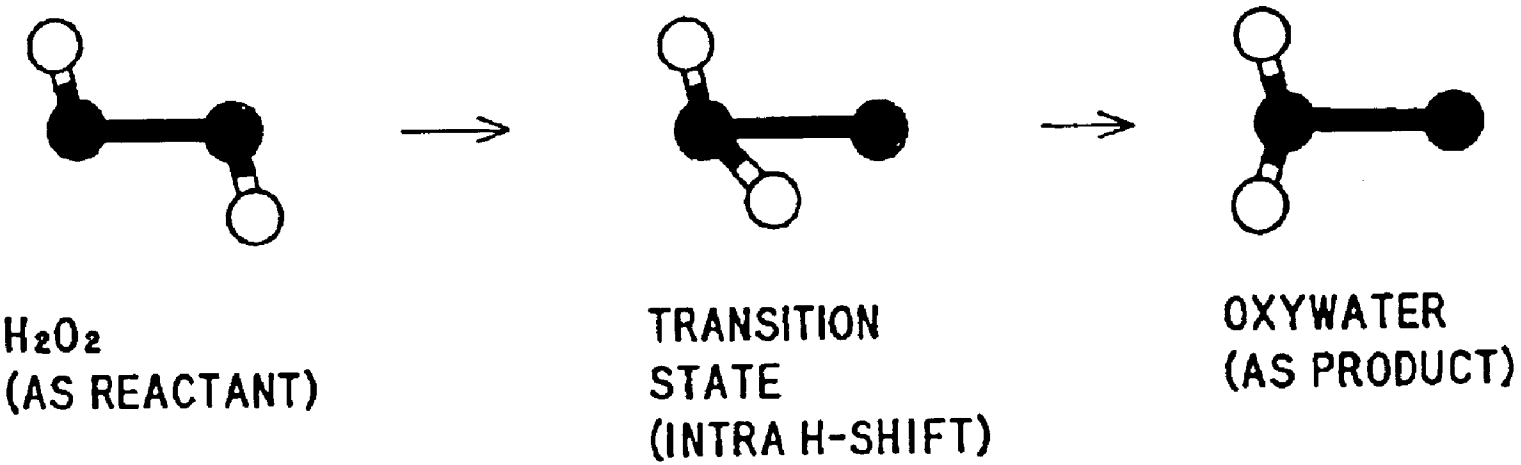
FIG. 2 shows a structural change of an isolated $H_2O_2$ molecule in the production of $H_2OO$ from $H_2O_2$ in a gas phase.

FIG. 1 shows potential energy surfaces obtained at the MP2/aug-cc-pVDZ level of theory for the case where zero to three molecule(s) of $H_2O$ participate in a reaction of forming $H_2OO$ from one molecule of $H_2O_2$ in a gas phase. When $H_2O$ does not participate as shown in FIG. 2 (in FIG. 1, it is shown as isolated $H_2O_2$), $H_2OO$ is formed via a transition state in that one of the H atoms the $H_2O_2$ molecule produces moves between two O atoms. This transition state is a so-called late transition state near $H_2OO$ and the reaction barrier is surprisingly high (57.14 kcal/mol). By calculating the potential energy surface of the dissociation of O atom from $H_2OO$, it has been found that irradiation with an electromagnetic field of 0.4 eV or more energy will promote dissociation, if the condition for intersystem-crossing of a singlet-triplet is achieved, while, for the usual spin-conserved dissociation, irradiation with electromagnetic field of 1 eV or more energy will do.

Figure 3:
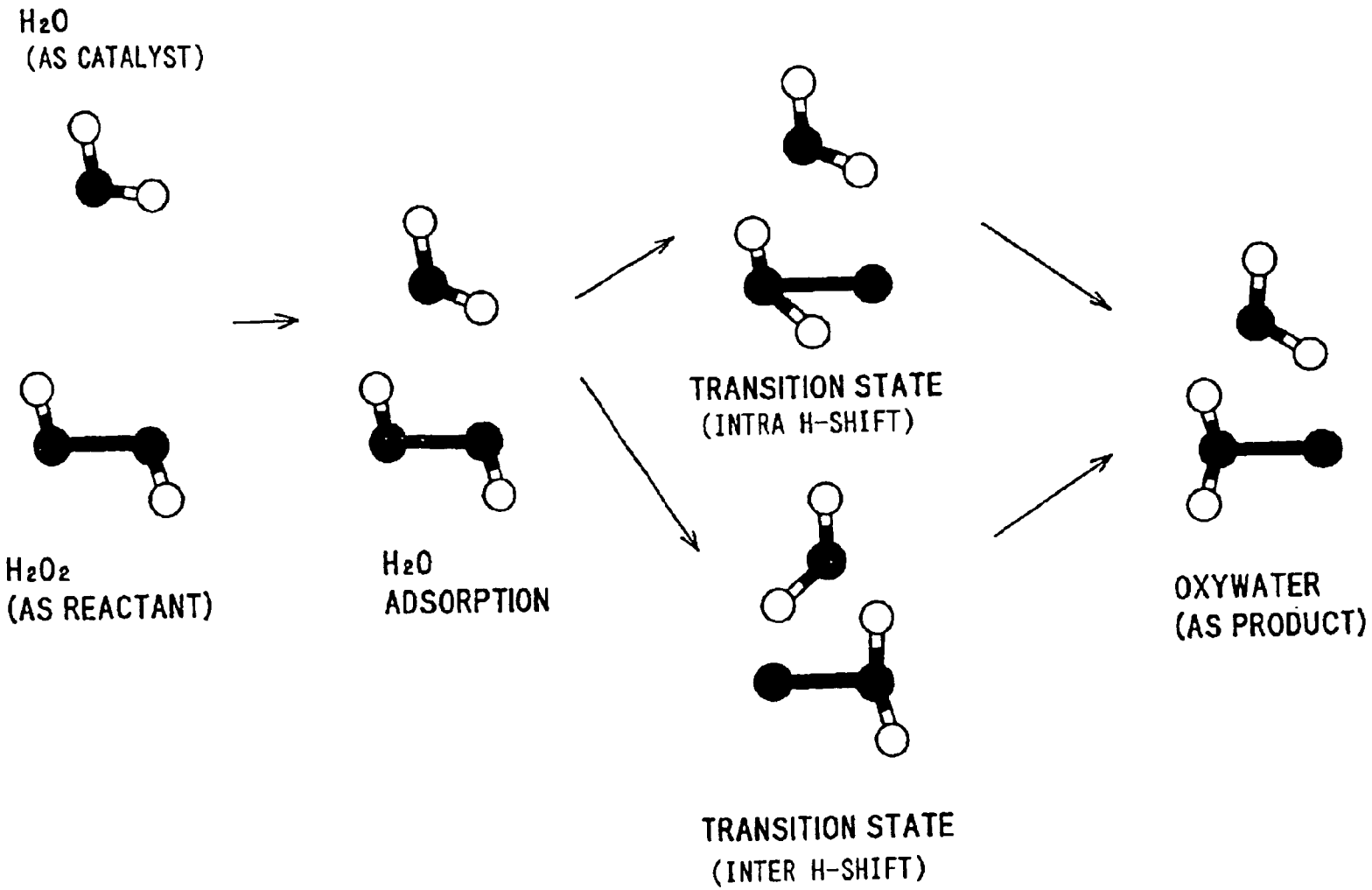
FIG. 3 shows a structural change of an $H_2O_2$ molecule with an $H_2O$ molecule in the production of $H_2OO$ from $H_2O_2$ in a gas phase.

When one molecule of $H_2O$ participates (shown as $1H_2O$ at n=1 in FIG. 1), the $H_2O$ molecule is adsorbed, as shown in FIG. 3, by a bifunctional (both proton-donative and proton-acceptive character) formation of two hydrogen bonds with H and O atoms of an $H_2O_2$ molecule. In a path of intramolecular hydrogen transfer within an $H_2O_2$ molecule, $H_2OO \cdot H_2O$ is formed via a transition state of a 1,2-hydrogen shift that is substantially equivalent to the case where no $H_2O$ molecule participates. As shown in FIG. 1, the barrier in this case (49.29 kcal/mol) decreases by 8 kcal/mol, as compared with the barrier when no $H_2O$ molecule participates. On the other hand, along a path of intermolecular hydrogen transfer between $H_2O_2$ and $H_2O$ molecules, $H_2OO \cdot H_2O$ is formed via a transition state of a 1,4-hydrogen shift. The barrier in that case (37.87 kcal/mol) is lower by 10 kcal/mol as compared to that of the 1,2-hydrogen shift.

Figure 4:
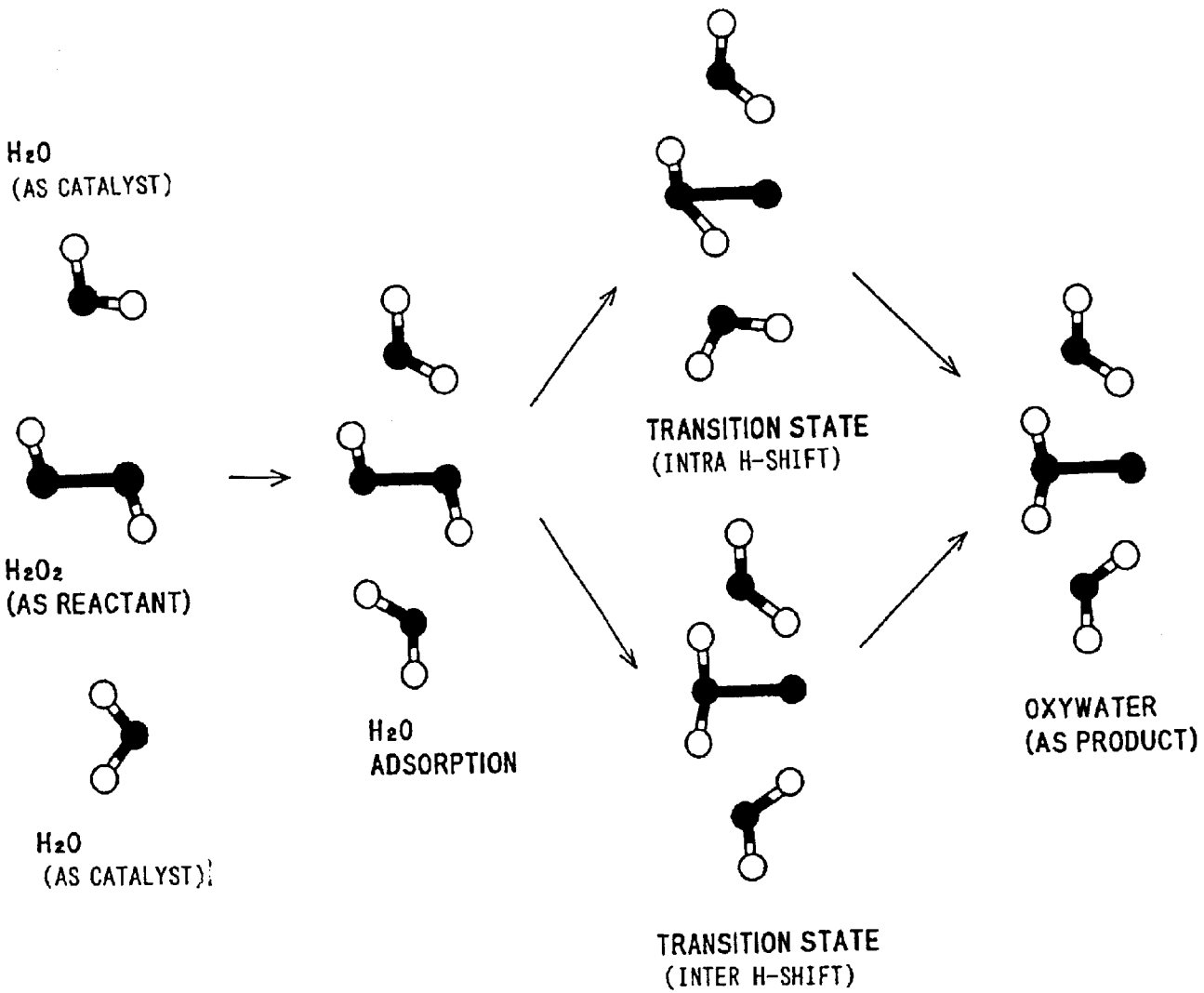
FIG. 4 shows a structural change of an $H_2O_2$ molecule with two $H_2O$ molecules in the production of $H_2OO$ from $H_2O_2$ in a gas phase.

When two molecules of $H_2O$ participate, there will be four reaction paths, i.e., three paths where two molecules of $H_2O$ form a dimer followed by adsorbing with an $H_2O_2$ molecule, and another path where each of two $H_2O$ molecules is adsorbed with an $H_2O_2$ molecule as a monomer. As shown in FIG. 4, when each of two $H_2O$ molecules is adsorbed with an $H_2O_2$ molecule as a monomer (shown as $2H_2Os$ in FIG. 1), a barrier of 1,2-hydrogen shift, which is an intramolecular hydrogen transfer path, is 48.56 kcal/mol, while that of 1,4-hydrogen shift, which is an intermolecular hydrogen transfer path, is 31.51 kcal/mol. The former is nearly the same as in the case where one molecule of $H_2O$ participates, but in the latter, there is a decrease of 6 kcal/mol as compared to the case of one $H_2O$ molecule participant.

Figure 5:
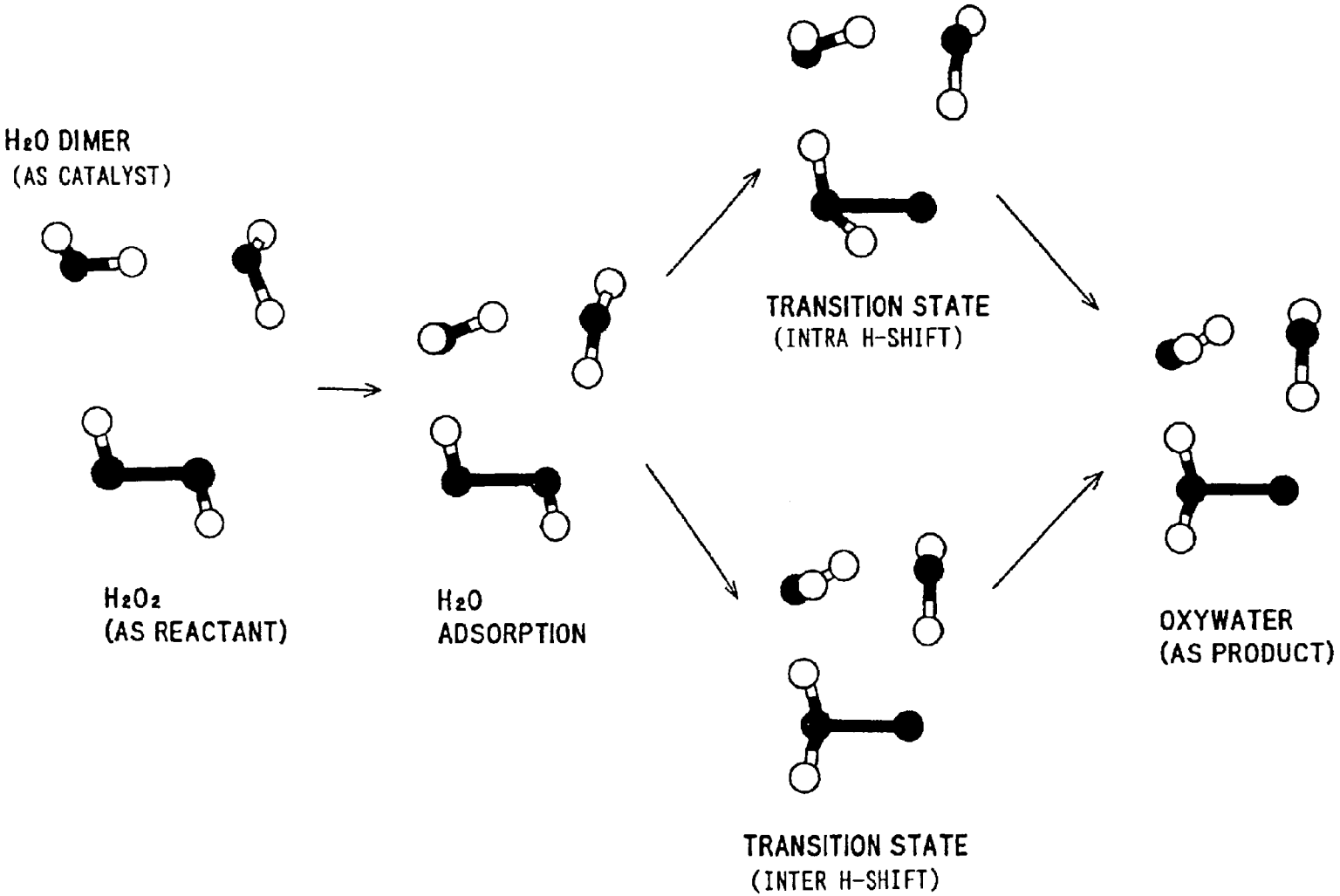
FIG. 5 shows a structural change of an $H_2O_2$ molecule with a dimer of $H_2O$ molecules in the production of $H_2OO$ from $H_2O_2$ in a gas phase.

On the other hand, regarding the three paths where two molecules of $H_2O$ form a dimer and adsorb with an $H_2O_2$ molecule, as shown in FIG. 5, for example, H in one $H_2O$ forms a hydrogen bond as proton donors with 0 in an $H_2O_2$ molecule, and simultaneously O in the other $H_2O$ forms a hydrogen bond as a proton acceptor with H in an $H_2O_2$ molecule. The barriers (in the order of intramolecular and intermolecular hydrogen transfers) were path 1 (45.32, 33.13), path 2 (45.58, 33.64), and path 3 (46.39 and 34.69) kcal/mol, respectively.

It is noted from the above that, when two molecules of $H_2O$ form a dimer and adsorb with $H_2O_2$, the adsorption state is stabilized to an extent of a hydrogen bond between two $H_2O$ molecules, as compared with the case of adsorption as a monomer and that, due to more stabilization of a 1,2-hydrogen shift transition state than that of barriers of the intramolecular hydrogen transfer paths, decrease to an extent of about 4 kcal/mol. Such a decrease is due to the fact that an interaction between an H atom of an $H_2O$ molecule is positively polarized by formation of a dimer, and an O atom of an $H_2O_2$ molecule is negatively polarized by an intramolecular hydrogen transfer process is enhanced, or in other words, energy is required for relaxation of internal strain of an $H_2O_2$ molecule by an $H_2O$ molecule (which is a catalyst and which is shown in the LUMO, HOMO and 2nd HOMO shift).

On the other hand, in a system in which two molecules of $H_2O$ participate, barriers in intermolecular 1,4-hydrogen shift paths, where $H_2O$ is adsorbed as a dimer, increase to an extent of about 2 kcal/mol as compared to the case where $H_2O$ is adsorbed as two monomers. This is because, in the 1,4-hydrogen shift transition state, dimer paths are only a little more stable than a monomer path, but $H_2O$-adsorbed states are more stable than that of dimer paths. Incidentally, it is same in the 1,4-hydrogen shift transition state as well, that there is a strong interaction between an H atom of a positively polarized $H_2O$ molecule by formation of a dimer, and an O atom of a negatively polarized $H_2O_2$ molecule by an intermolecular hydrogen shift.

A particularly noteworthy point for both the system in which one $H_2O$ molecule participates and the system in which two $H_2O$ molecules participate is that, in the system where two $H_2O$ molecules participate, endothermic energy upon production of oxywater measured from a dissociation limit is significantly decreased as compared with the system where one $H_2O$ molecule participates, regardless of monomer and dimer paths. Such a tendency is more significant, particularly, in an intermolecular hydrogen transfer path. The above result shows that, in a process where the adsorption energy resulting from adsorption of an $H_2O$ molecule with an $H_2O_2$ molecule is not dispersed (or relaxed), but is conserved as an excess internal energy, or in gas phase processes (dry processes), the adsorption energy can be effectively utilized to the above endothermic energy (external work).

Figure 6:
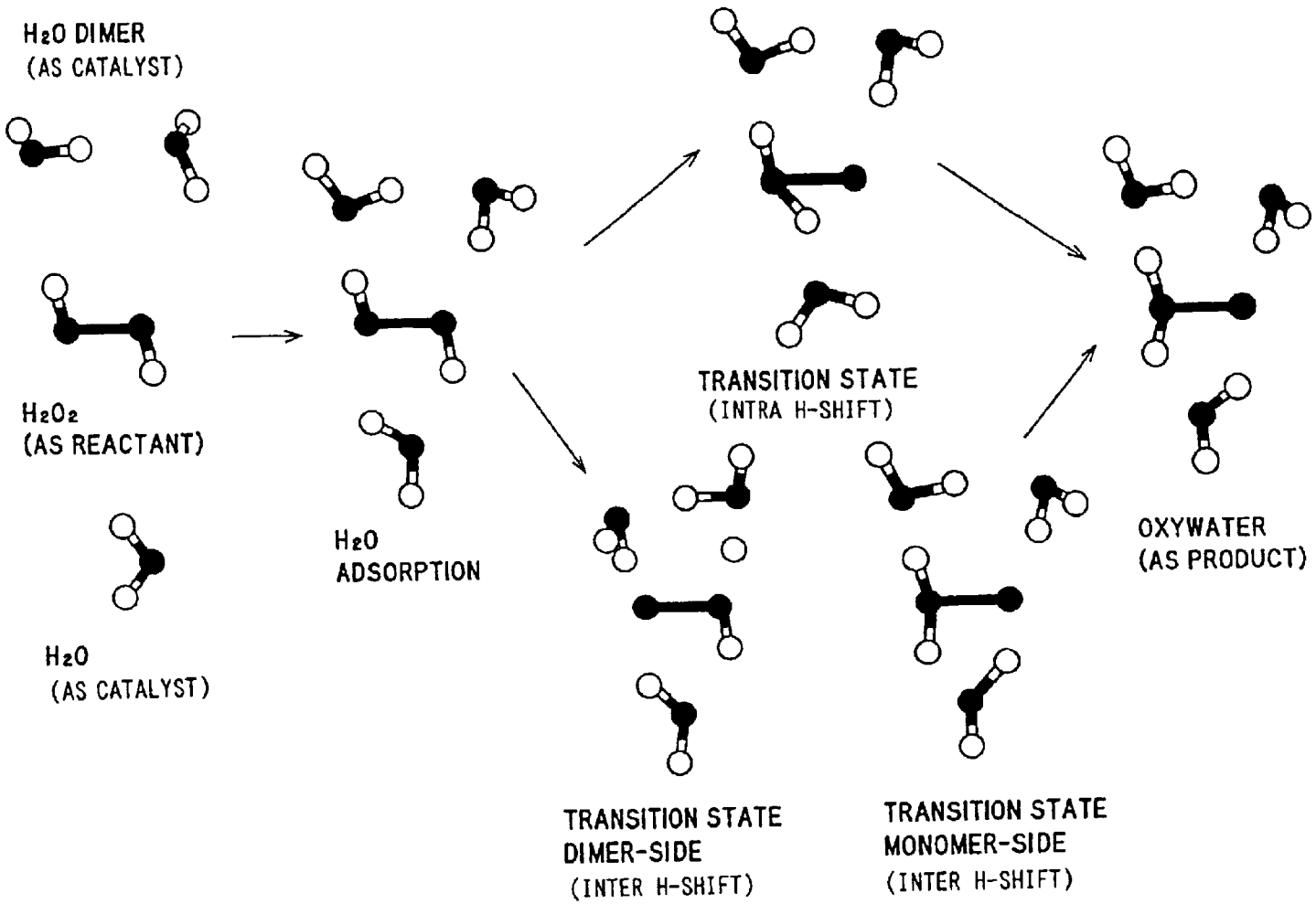
FIG. 6 shows a structural change of an $H_2O_2$ molecule with three $H_2O$ molecules in the production of $H_2OO$ from $H_2O_2$ in a gas phase.

When three molecules of $H_2O$ participate, several reaction paths may be considered as well. When the third $H_2O$ molecule is added to a system in which two molecules of $H_2O$ participate as a dimer, it is easily presumed that the interaction is the strongest in the case where the third $H_2O$ molecule is adsorbed by formation of a hydrogen bond in a bifunctional manner with a $H_2O_2$ molecule. When the first and the second $H_2O$ molecules interact with an $H_2O_2$ molecule by dimer paths, the third $H_2O$ molecule is able to independently form hydrogen bonds with an $H_2O_2$ molecule in a bifunctional manner. Thus, as shown in FIG. 6, the case may be considered where a dimer comprising the first and the second $H_2O$ molecules interacts with one HOO structure of the $H_2O_2$ molecule, while the third $H_2O$ molecule interacts with another HOO structure.

On the other hand, when the first and the second $H_2O$ molecules interact with an $H_2O_2$ molecule via a monomer path, the proton-donating site of the $H_2O_2$ molecule is exhausted and, therefore, it is disadvantageous that the third $H_2O$ molecule independently interacts with an $H_2O_2$ molecule. Accordingly, there is no way but for the third $H_2O$ molecule to interact with the first or the second $H_2O$ molecules. Thus, any of the first and the second $H_2O$ molecules forms a dimer structure with the third $H_2O$ molecule, whereupon the final adsorption structure becomes identical with the dimer paths previously mentioned.

Characteristics of the case wherein three $H_2O$ molecules participate will be summarized as follows.

(1) Adsorption energy as a result of adsorption of the third $H_2O$ molecule increases to an extent of 8–10 kcal/mol more as compared with the system in which two $H_2O$ molecules participate.

(2) After adsorption of an $H_2O$ dimer, the difference between the barrier of intermolecular hydrogen transfer between $H_2O_2$ and an $H_2O$ monomer and the barrier of intermolecular hydrogen transfer between $H_2O_2$ and an $H_2O$ dimer, is as little as 1 kcal/mol, or less.

(3) A 1,4-hydrogen shift barrier from an adsorption state is about 28 kcal/mol, while a 1,4-hydrogen shift barrier measured from a dissociation limit, is nearly zero.

Thus, when a reaction condition is controlled so as to form a cluster consisting of one $H_2O_2$ molecule and three $H_2O$ molecules, oxywater that is an oxidizing species can be efficiently produced.

Now, in order to show that the result obtained by the above investigation is characteristic in a gas phase reaction, and is advantageous in terms of reaction potential energy, as compared with the reaction under a simple wet (liquid phase) condition, reaction paths in uniform dielectrics (water having a specific dielectric constant $\epsilon$=78.3) were investigated by a Self-Consistent Reaction Field method (SCRF method) for a reaction system wherein either none or one $H_2O$ molecule participate. First, a calculation method therefor will be explained as follows.

In water of a standard state, about ten to 50 water molecules take a cooperative motion, due to a hydrogen bond between them, and a dipole interaction whereupon an environment showing a specific dielectric constant of $\epsilon$=78.3 is formed. This environment can be, of course, reproduced if a very large cluster model is used. A solvent effect model is also efficient, where environmental water of surroundings around the chemically active center (reaction site) is homogeneously incorporated as a macroscopic medium having a specific dielectric constant, $\epsilon$, and said means is applicable to an organic solvent environment as well. Here, a system of $H_2O_2$+n$H_2O$ (n=0, 1) was used, and the change in a reaction potential surfaces both with and without consideration of the solvent effect was investigated.

Consideration of the solvent effect was carried out using two kinds of reaction field models of salvation, where one method of locating a solvate molecule into cavities in uniform dielectrics is different from the other method. Incidentally, one of the models is the simplest model, and is known as the Onsager model (dipole and sphere model), wherein a molecule having an electric dipole moment is placed into a predetermined fixed spherical cavity having a desired size. Here, a region where radius $a_0$ of the spherical cavity has a value of 0.5 Å, which is a typical van der Waals radius of a solvent molecule, is added to the radius of a region giving the electron density of 0.001 electrons/bohr$^3$ by a Monte-Carlo calculation.

Another model is a Self-Consistent Isodensity Polarized Continuum Model (SCIPCM) where an isodensity surface (0.0004 au) of a solute molecule is adopted as a cavity, and the cavity shape is determined self-consistently with regard to the charge density in order to minimize the total energy, including solvation energy.

BHandHLYP/aug-cc-pVDZ level of theory was also employed. The results will be explained below by referring to FIG. 7.

Figure 7:
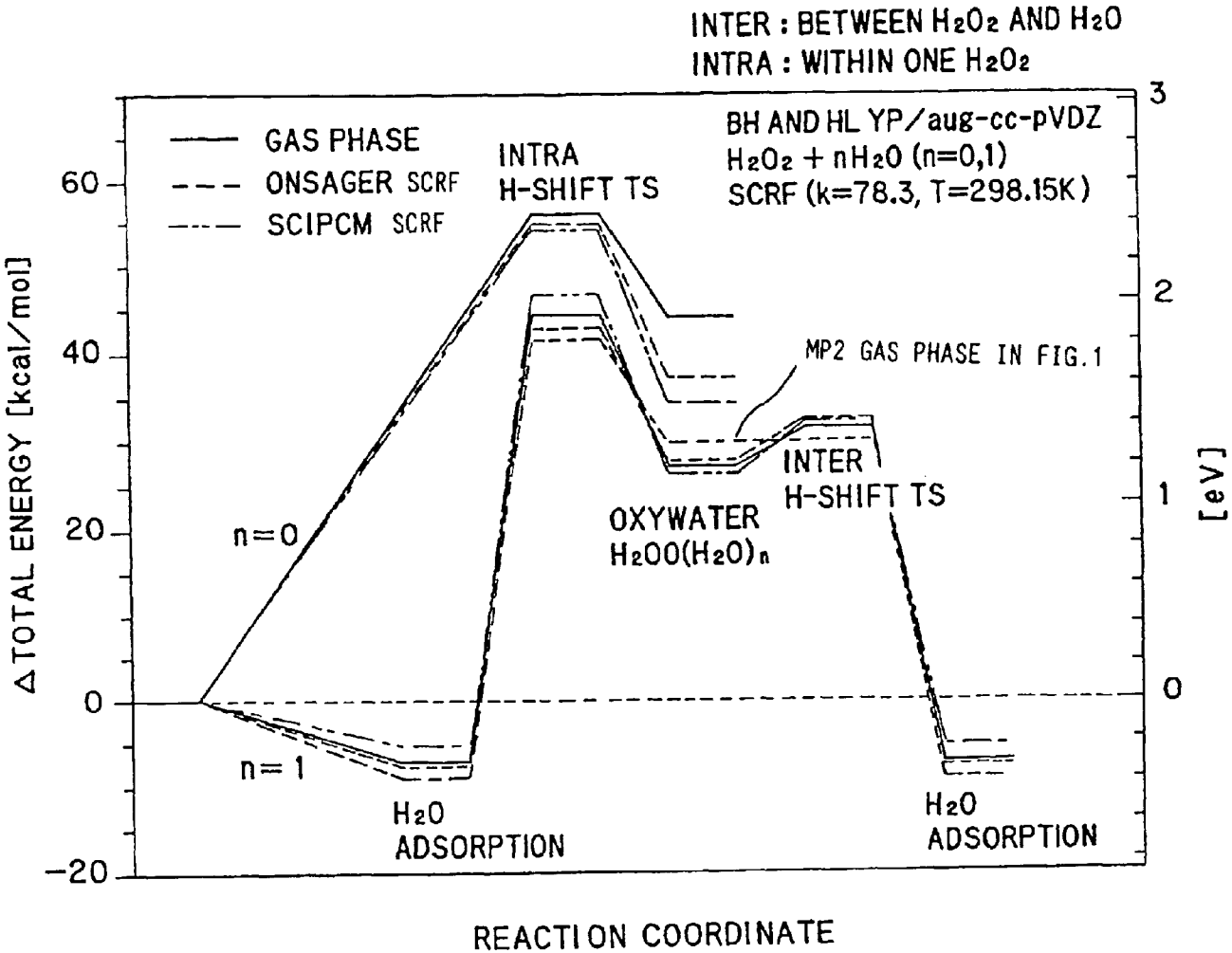
FIG. 7 is a graph showing the potential energy changes along the reaction paths of the production of $H_2OO$ from $H_2O_2$ in a liquid phase.
Figure 8:
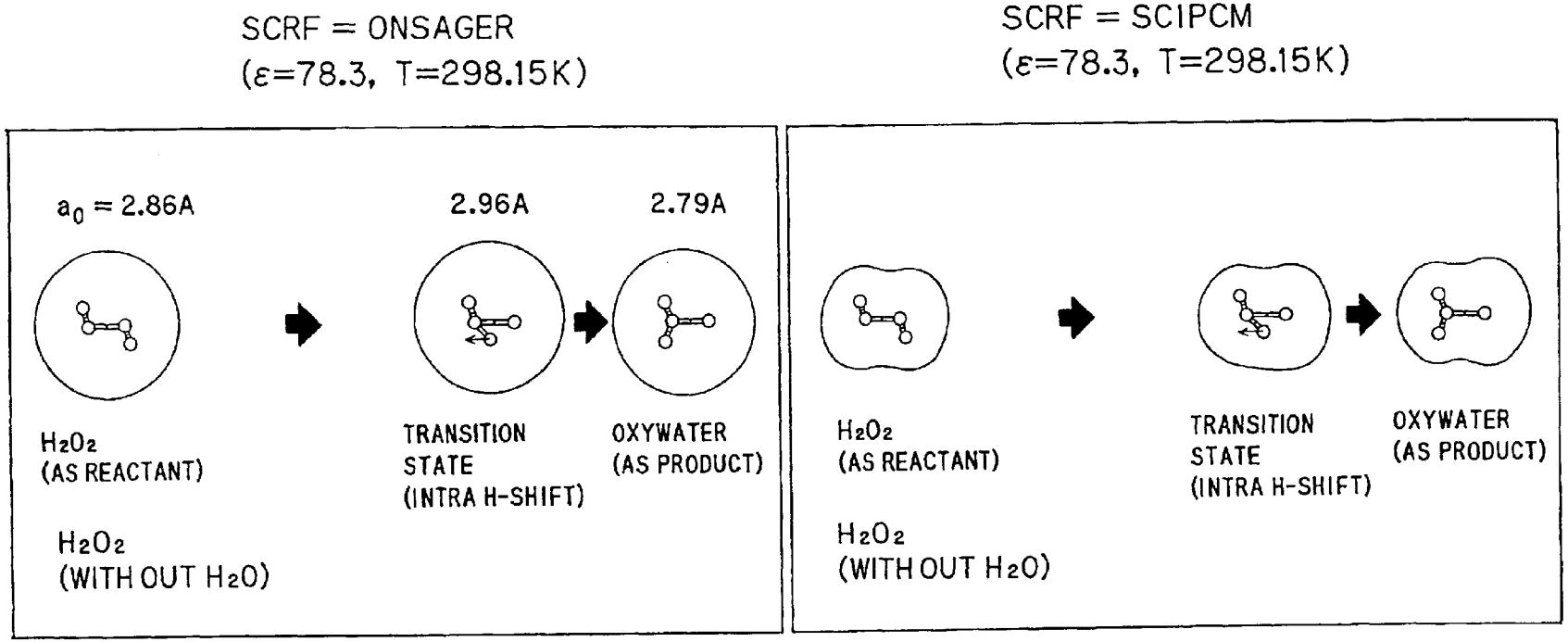
FIG. 8 shows a structural change of an $H_2O_2$ molecule in a liquid phase in which no $H_2O$ molecule participated.
Figure 9:
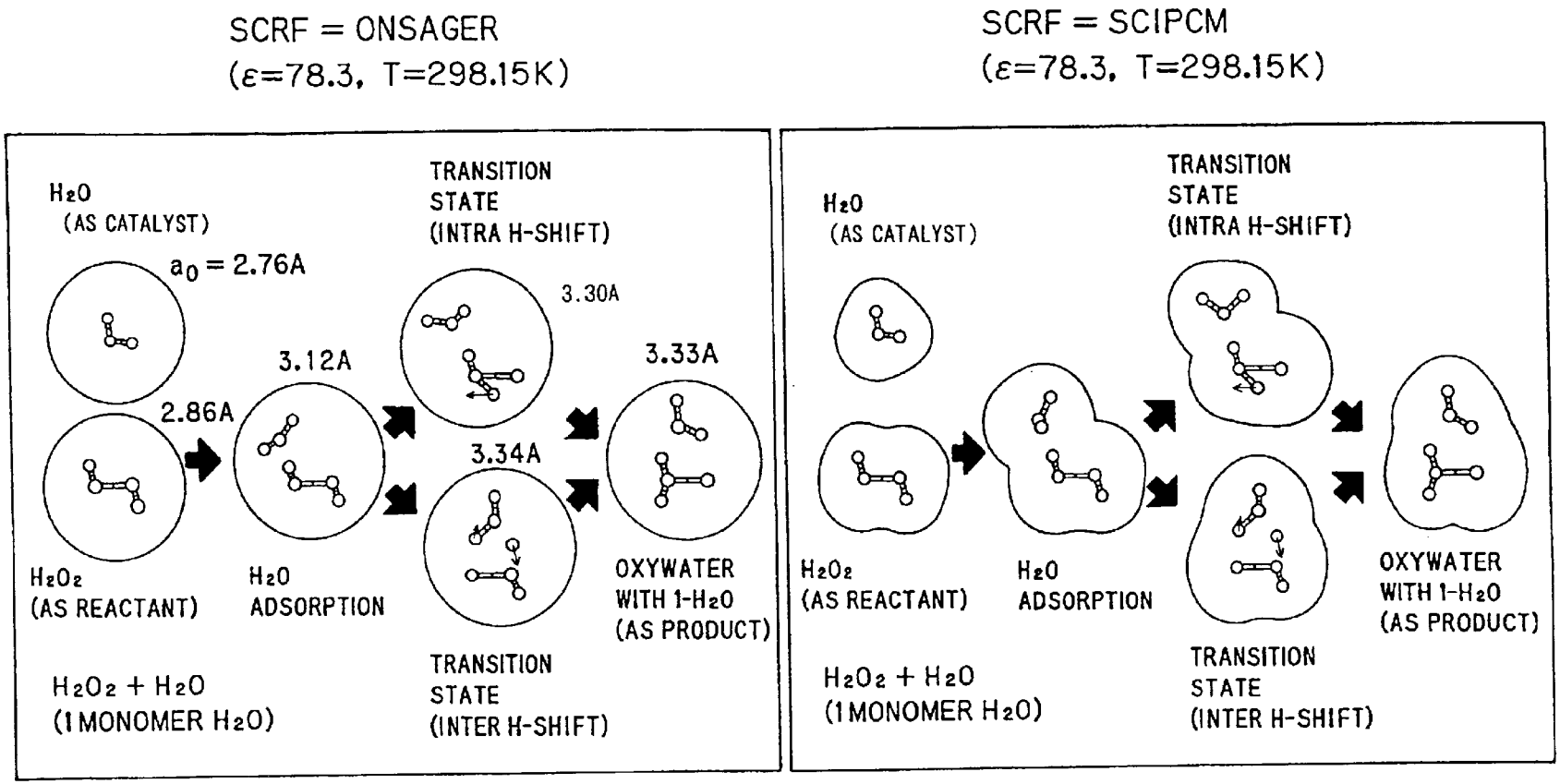
FIG. 9 shows a structural change of an $H_2O_2$ molecule in a liquid phase in which one $H_2O$ molecule participated.

FIG. 7 is a graph showing potential energy changes along the reaction paths of the production of $H_2OO$ from $H_2O_2$ in a liquid phase. Changes in energy are summarized in Tables 4 and 5. Incidentally, structural change along each reaction shown in FIG. 7 is shown in FIG. 8 and FIG. 9, in which FIG. 8 shows a structural change in the reaction, wherein no $H_2O$ molecule participated, while FIG. 9 shows a structural change in the reaction wherein one $H_2O$ molecule participated. The round line around each structure of a "solute" cluster in FIGS. 8 and 9 shows a spherical cavity of radius $a_0$ mentioned above in the case of an Onsager model, while, in the case of SCIPCM, they show isodensity surfaces of 0.0004 au, respectively.

TABLE 4

Reaction energies of $H_2O_2$ + n$H_2O$ → $H_2OO$·n$H_2O$ (n = O) system in both gas and liquid phases, at the BHandHLYP/aug-cc-pVDZ level of theory [kcal/mol].

| Levels of theory | activation energy ($E_a^{for}$) | stabilization energy after TS ($E_a^{rev}$) |
|---|---|---|
| gas $\epsilon$ = (1 MP2) | 57.144 | 7.454 |
| gas $\epsilon$ = 1 | 56.179 | 12.037 |
| Onsager $\epsilon$ = 78.3 | 55.019 | 17.692 |
| SCIPCM $\epsilon$ = 78.3 | 54.264 | 19.805 |

TABLE 5

Reaction energies of $H_2O_2$ + n$H_2O$ → $H_2OO$·n$H_2O$ (n = 1) system in both gas and liquid phases, at the BHandHLYP/aug-cc-pVDZ level of theory [kcal/mol].

| levels of theory | $H_2O$ adsorption | activation energy 1,2 H-shift (intra) ($E_{a:1,2TS}^{for}$) | stabilization energy after 1,2TS ($E_{a:1,2TS}^{rev}$) | activation energy 1,4 H-shift (inter) ($E_{a:1,4TS}^{rev}$) | stabilization energy after 1,4TS ($E_{a:1,4TS}^{rev}$) |
|---|---|---|---|---|---|
| gas $\epsilon$ = 1 (MP2) | 7.626 | 49.291 | 11.744 | 37.863 | 0.317 |
| gas $\epsilon$ = 1 | 7.031 | 51.585 | 17.276 | 38.714 | 4.405 |
| Onsager $\epsilon$ = 78.3 | 8.939 | 51.933 | 15.130 | 41.658 | 4.855 |

TABLE 5-continued

Reaction energies of $H_2O_2 + nH_2O \rightarrow H_2OO \cdot nH_2O$ (n = 1) system in both gas and liquid phases, at the BHandHLYP/aug-cc-pVDZ level of theory [kcal/mol].

| levels of theory | $H_2O$ adsorption | activation energy 1,2 H-shift (intra) ($E_{a:1,2TS}^{for}$) | stabilization energy after 1,2TS ($E_{a:1,2TS}^{rev}$) | activation energy 1,4 H-shift (inter) ($E_{a:1,4TS}^{rev}$) | stabilization energy after 1,4TS ($E_{a:1,4TS}^{rev}$) |
|---|---|---|---|---|---|
| SCI-PCM $\epsilon$ = 78.3 | 5.217 | 51.952 | 20.326 | 37.697 | 6.071 |

It has been noted from the change in geometry that the more the polarization in the structure (transition state, producing system), the more the change, although it is less than about 2% between the cases of the presence and the absence of a reaction field (dipolar field).

First, an autolytic reaction of $H_2O_2$, wherein $H_2O$ does not participate, will be considered. An autolytic reaction of $H_2O_2$ in a gas phase ($\epsilon$=1) is an endothermic reaction having a very high barrier in both a path forming two OH radicals and a path producing $H_2OO$ (→O atom), and photodissociation and metal catalyst are needed to promote the reaction. Such a tendency was unchanged even when the reaction field was taken into consideration. Reduction in a reaction barrier is only about 1 kcal/mol in an Onsager field and is about 2 kcal/mol in a SCIPCM field. The absolute value of Mulliken charges on each atom increases in the order of gas phase→Onsager field→SCIPCM field. Accordingly, the electric dipole moment of a molecule increases as well, although the amount of the change from the initial state to the transition state is almost equal.

Therefore, the difference in the reaction field corresponding to the difference in induced electric dipole moment becomes small. Finally, although the PES from the initial state to the transition state is nearly same, the PES from the transition state to the product ($H_2OO$) is considerably different, and the stabilization energy (or, in other words, barrier of reverse reaction) increases by about five to eight kcal/mol. Changes in Mulliken charge in gas phase and liquid phase (SCRF models) are also very large as compared with those of the initial state and the transition state. $H_2OO$ itself is greatly polarized and, therefore, an O atom, having an excess negative charge, expresses a strong oxidative property and reaction field further promotes such a large polarization.

It is preferred for autolysis that stabilization of $H_2OO$ (product) is increased by a solvent effect. However a decrease in a reaction barrier to the forward direction exceeding 50 kcal/mol is small and, accordingly, a solvent effect due to autolysis by an $H_2O_2$ molecule alone cannot be expected.

Therefore, the solvent effect in the case of participation of $H_2O$ (one molecule), where a catalytic effect has been confirmed in a "gas phase" reaction system, will be considered.

First, in an adsorption structure of $H_2O$ with $H_2O_2$, a structure where $H_2O$ interacts with $H_2O_2$ in a bifunctional (i.e. proton donative/acceptive) manner, is obtained in a gas phase while, under a uniform dielectric environment, $H_2O$ takes a structure of being adsorbed with $H_2O_2$ as a proton acceptor.

In a transition state, $H_2O$, where electric dipole moment is larger by about 20%, is more strongly affected than $H_2O_2$ by a reaction field of water having $\epsilon$=78.3. Accordingly, hydrogen bond formation between an O atom of $H_2O_2$ and an H atom of $H_2O$ is suppressed in the case of an intramolecular hydrogen shift process. This weakens the effect of promotion of negative polarization of an O atom that is to express the oxidative property. Even in the case of an intermolecular hydrogen shift process, an O atom in $H_2O$ effectively works to abstract H from $H_2O_2$ as a proton acceptor during the step from adsorption to a transition state, but an effect of promotion of O and H donation to $H_2O_2$ is small.

Therefore, changes in the reaction barrier due to reaction field are very small, in both intramolecular and intermolecular hydrogen shifts. Rather, a decrease in barrier by participation of an $H_2O$ molecule (four to five kcal/mol) is larger and far more effective than that, and the difference of five kcal/mol, at around room temperature, corresponds to a difference of 500 times in the speed estimated by the Boltzmann factor.

The above suggests that the barrier decrease in a reaction system of an $H_2O_2$ molecule with several $H_2O$ molecules is not characteristic in a liquid phase due to an dielectric interaction, but is rather achieved only by a cooperative reaction with $H_2O_2$ and $H_2O$ as already clarified in a gas phase reaction system.

Finally, since polarization of the product $H_2OO$ that is an oxidative species becomes largest on a PES, a large effect of the reaction field is expected. The result of a SCIPCM field, which is a more appropriate reaction field model, supports the result that stabilization energy becomes larger, in both intramolecular and intermolecular hydrogen shifts, although the degree is small.

On the contrary, this is not always the case in an Onsager field model. Although the polarization at the $H_2OO$ side increases due to the reaction field, at the $H_2O$ side it is rather smaller than in a gas phase system. The most noteworthy thing concerning the oxidative property of $H_2OO$ is that, although the size of the negative charge of an O atom that is to express an oxidative property becomes large by taking the reaction field into consideration, it does not undergo additional change even when one molecule of $H_2O$ participates.

In the case of a gas phase reaction system, when the number of catalytic $H_2O$ molecules increases as 0, 1, 2 and 3, the Mulliken charge of an O atom that is expressed as an oxidative property increases as −0.5052 (no $H_2O$ molecule), −0.5394 (one $H_2O$ molecule), from −0.5662 to −0.5902 (two $H_2O$ molecules), and from −0.5981 to −0.6180 (three $H_2O$ molecules) (values at the MP2/aug-cc-pVDZ level of theory). In an SCRF model used at this time, although the charge distribution has not achieved the experimental value yet, the effect of the reaction field may be almost saturated when $\epsilon$=78.3. Thus, even when many $H_2O$ molecules try to promote the polarization of $H_2OO$ as a liquid phase (for example, as an average sum of electric dipoles in various directions), it is likely that the resulting effect is almost saturated in the polarized value obtained by these calculations.

However, when plural $H_2O$ molecules interact in an optimum steric configuration as in a gas phase reaction system, polarization of $H_2OO$ is still promoted by at least up to three molecules of ancillary $H_2O$. Reactivity (oxidative property) of $H_2OO$ can be controlled whether the electric dipole interaction from plural $H_2O$ molecules is utilized "homogeneously" or "orientation-dependently." That is, the second advantage by the use of a gas phase reaction system instead of a liquid phase one is based upon a dielectric interaction. The first advantage is, of course, a decrease in the reaction barrier.

In summary, it has now been clarified from the consideration of the reaction field that:

(1) in both the cases of an $H_2O_2$ autolytic reaction system and a single-molecule $H_2O$ catalytic system, a decrease in a reaction barrier noted is as small as one to two kcal/mol at best; and (2) although the Mulliken charge (polarization charge) on each atom, which is an index for an oxidative property of an oxidative species ($H_2OO$), becomes large when the reaction field is taken into consideration, there is no additional change even if $H_2O$ participates.

From the above, it has been clarified that the catalytic effect of $H_2O$, i.e., an enhancing effect of oxidative property and an apparent reaction barrier decrease (3) is not due to an dielectric character which is caused by $H_2O$ as a group, and (4) is an intermolecular direct reaction characteristic in a gas phase reaction system, which is only achieved by a cooperative reaction of $H_2OO$ with $H_2O$.

The above suggests that, in promotion of formation of an oxidative species in an $H_2OO+nH_2O$ system and in control of their oxidative properties, water molecules in such numbers that cause a dielectric property (e.g., liquid or solid phase) are not necessary, whereby this is able to contribute to the reduction in amount of pure water used.

However, in order to effectively utilize the apparent barrier decrease, it is important as a process condition that the adsorption energy of $H_2O$ with an $H_2O_2$ molecule should not be dispersed, but rather be conserved, as an internal energy or the collisional relaxation of the reaction product should be suppressed although such a control in a liquid phase is difficult. Accordingly, the conclusion is that the production of oxywater is effective in carrying out in a gas phase reaction system. Instead of this, regarding the removal of contamination, it is necessary to consider a step corresponding to removal of metal ion by hydration, which is an advantage of the liquid phase reaction system, and a step corresponding to static electrical removal of particles by means of a zeta-potential regulation.

Results of the theoretical investigation concerning the intramolecular and the intermolecular hydrogen transfer process by one molecule of $H_2O_2$ and up to three molecules of $H_{20}$, as mentioned above, will be summarized as follows.

When the gas phase reaction system is achieved, an effect of reducing the barrier by oligomerization of an $H_2O$ molecule as a catalyst is noted in an intramolecular hydrogen transfer process in $H_2O_2$. Regarding an intermolecular hydrogen transfer process between $H_2O_2$ and $H_2O$, an effect by oligomerization of an $H_2O$ molecule is not noteworthy, although a barrier decrease results. Especially, the endothermic energy measured from the dissociation limit, i.e. the apparent reaction barrier, significantly decreases and can be made almost zero, when three molecules of $H_2O$ participate. On the other hand, when the conventional liquid phase reaction is considered merely as an effect of local electric field by dielectric property of hydrogen peroxide or water, the above apparent reaction barrier instead increases.

From those results, in order to produce an oxidative species in high efficiency in the system of hydrogen peroxide and water, it is preferable to satisfy the following requirements. That is, one molecule of hydrogen peroxide is suppressed with three molecules of water. In addition, hydrogen peroxide is not made to react with water in a bulk of a liquid phase or a gas phase, but each of them is separately supplied near the surface of the member, followed by making a reaction between them. Alternatively, when their cluster is formed in a bulk of gas phase, where the density is smaller to an extent of three or more orders of magnitude, as compared with a liquid phase, the cluster having the excess internal energy conserved during the cluster formation is supplied to the surface of the member together with suppressing the loss of the energy by collisional relaxation, whereupon an oxidative species is produced just on the surface of the member. Still alternatively, in order to supply hydrogen peroxide and water on the surface of the member together with suppressing their clustering, microwaves of three GHz or more are applied where rotational excitation of an $H_2O$ trimer, $H_2O$ dimer, $H_2O$ monomer, $H_2O_2$ dimer, and $H_2O_2$ monomer are possible. As a result of adoption of at least one of them, it is possible to produce an oxidative species with higher efficiency.

Now, surface treating using the oxidative species produced by the above-mentioned method will be explained.

Figure 10:
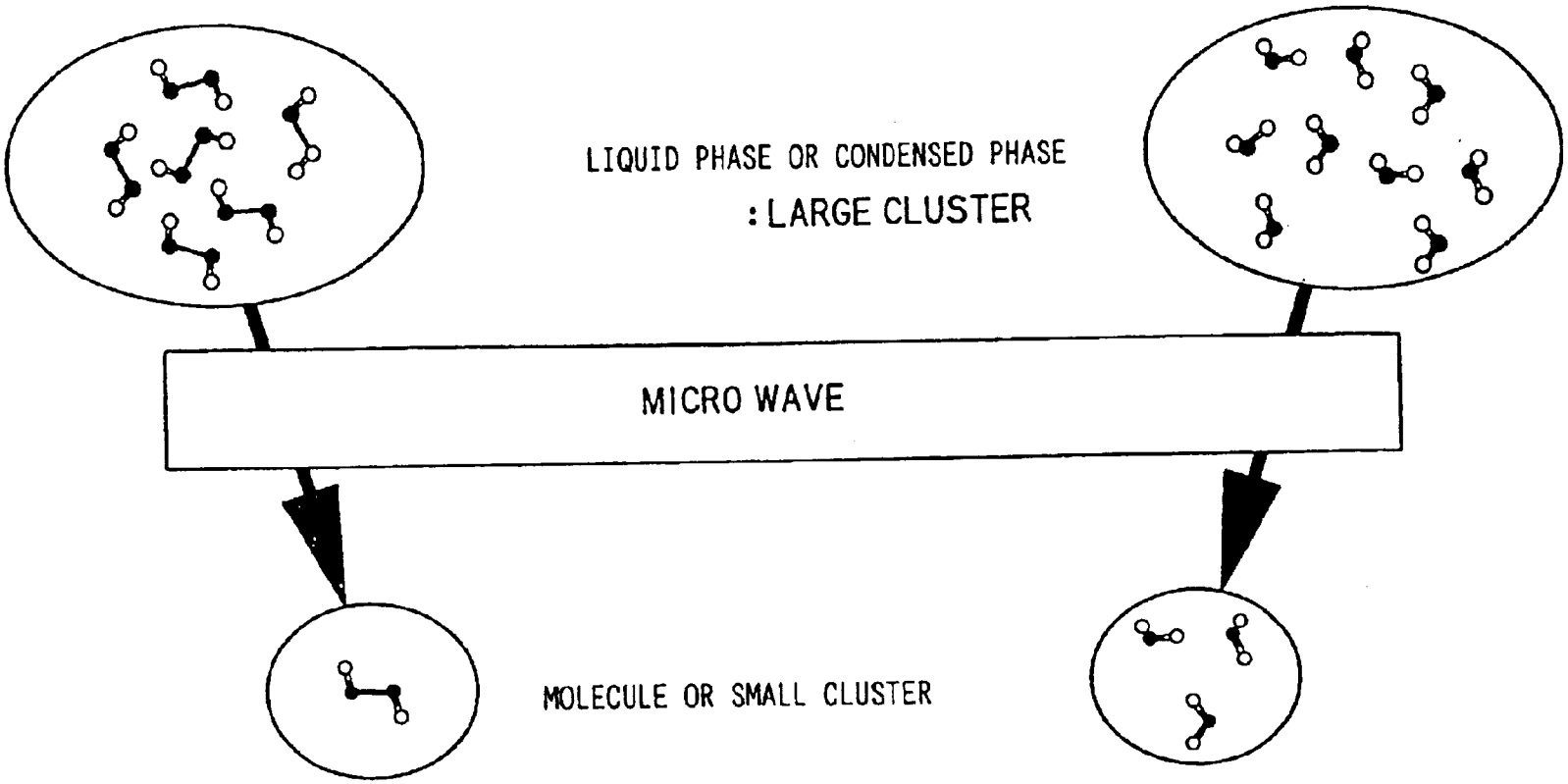
FIG. 10 schematically shows the surface treating method according to an embodiment of the present invention.
Figure 11:
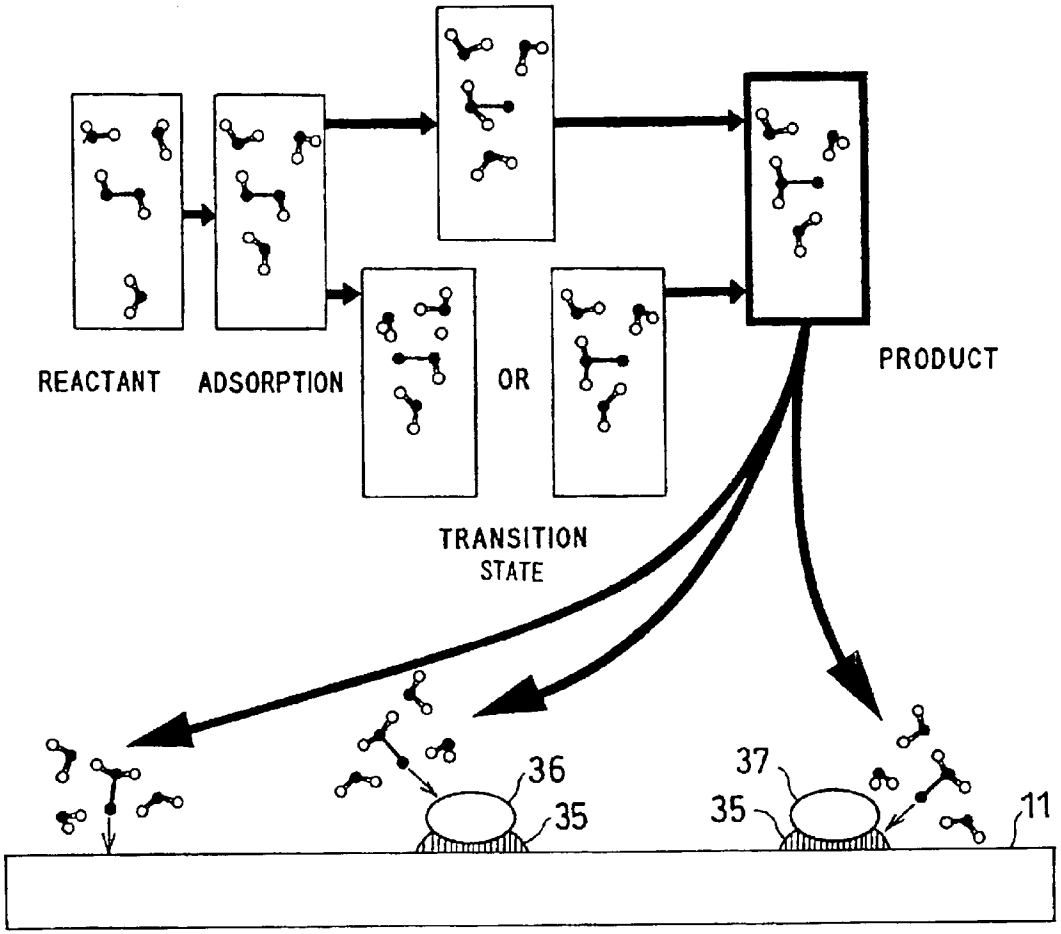
FIG. 11 schematically shows the surface treating method according to another embodiment of the present invention.

FIGS. 10 and 11 schematically show a surface treating method according to one embodiment of the present invention. In this embodiment, the case where the method of the present invention is applied to a cleaning treatment will be explained.

First, as shown in FIG. 10, microwaves irradiate $H_2O_2$ and $H_2O$ of a liquid phase or a condensed phase (such as vapor) which is essentially similar to a liquid phase. Although each of $H_2O_2$ and $H_2O$ forms a cluster in a large size, it is possible to selectively prepare a cluster in a small size by irradiation of a predetermined appropriate microwave frequency.

Then, as shown in FIG. 11, those clusters are supplied so that the molar ratio of $H_2O_2$ and $H_2O$ on the surface of Si substrate (11), which is the member to be treated on its surface, is 1:3, for example. The clusters supplied onto the surface of substrate (11) very efficiently produce an oxidizing species such as oxywater, whereupon organic substance (35) on the surface of Si substrate (11) is decomposed. Metal contamination (36) also forms a metal oxide from their surface. As a result, metal contamination (36), particles (37), etc., adhered to the surface of substrate (11) together with the organic substance, are removed. Incidentally, together with or after the decomposition of the organic substances, a fluorine-containing gas, such as HF or a chelating agent forming a chelate with metal, may be supplied if necessary. As a result, removing metal contamination, etc. is more efficient.

As in the case where the method of the present invention is applied to a cleaning treatment, as explained above, and, besides the cleaning of the surface of the member, the method of the present invention is also applicable, for example, to film-formation, such as formation of a silicon oxide film and a metal oxide film, to film-formation by chemical vapor phase growth and by physical vapor phase growth on the surface of the member, and to a surface treating, such as etching including a dry etching on the surface of the member.

Now, an apparatus for carrying out the above-mentioned surface treating will be explained.

Figure 12:
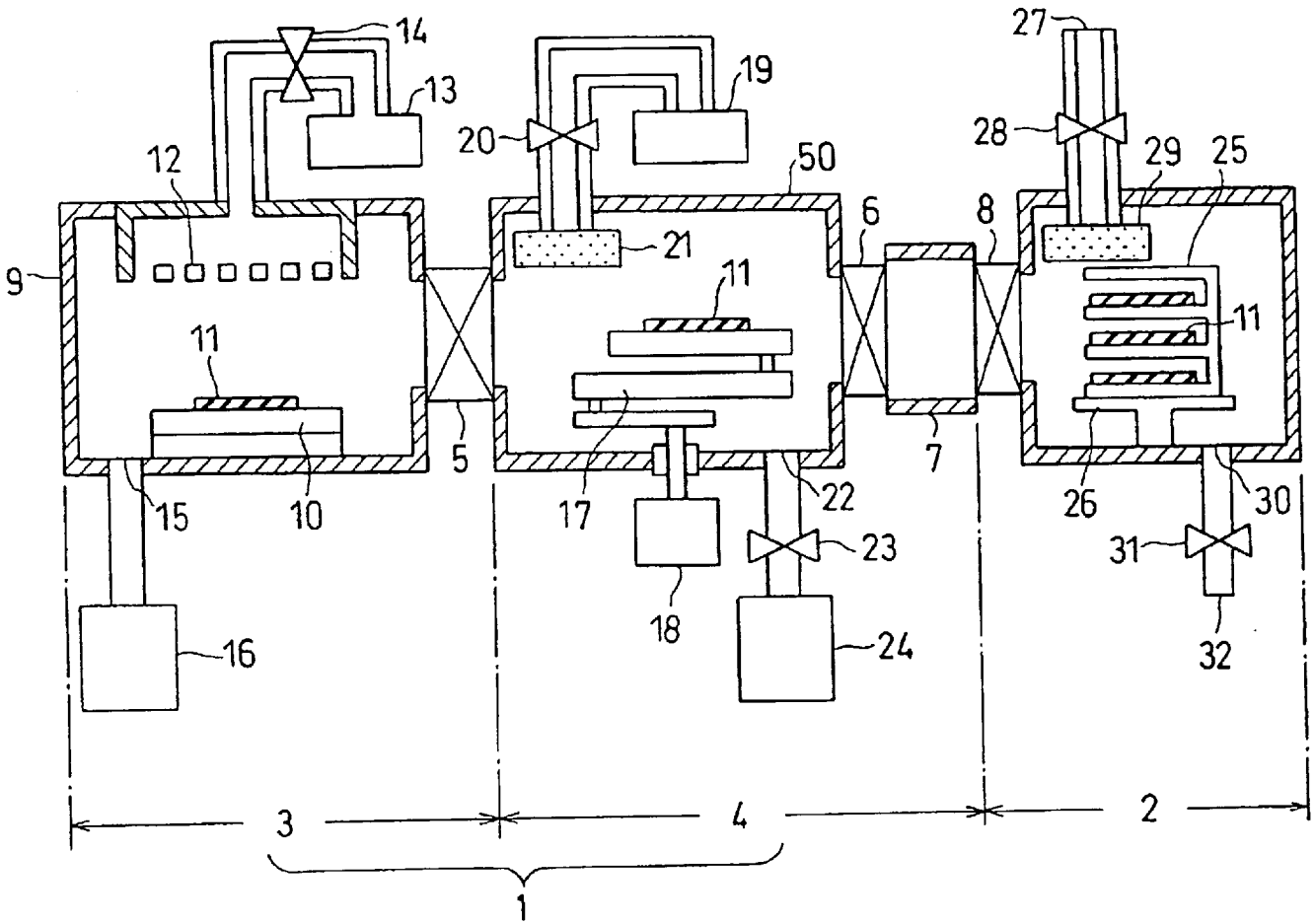
FIG. 12 schematically shows the surface treating system according to another embodiment of the present invention.

FIG. 12 schematically shows a surface treating system according to an embodiment of the present invention. The surface treating system shown in FIG. 12 is a surface treating system for the treatment of semiconductors, and is mainly composed of a semiconductor treating apparatus (1) and a receiving container (2) connected thereto.

Semiconductor treating apparatus (1) is mainly composed of treating chamber (3) and load lock chamber (4). Treating chamber (3) and load lock chamber (4) are connected via gate valve (5). Load lock chamber (4) and receiving container (2) are able to be connected by a cluster tool structure consisting of gate valve (6) placed between them, joint (7) connected to gate valve (6), and door (8) placed at the side wall of receiving container (2). Incidentally, the surface treating system shown in FIG. 12 may be in such a structure that plural treating chambers (3) can be connected by joining to load lock chamber (4) via gate valve (5).

A semiconductor treating apparatus (1) is an apparatus that carries out at least one of dry cleaning treatment, oxidation treatment, diffusion treatment, thermal annealing treatment, film-forming treatment, and etching treatment to substrate (11). Air-tight treating container (9) is installed in treating chamber (3) and, in this container (9), there is provided stand (10) on which substrate (11), which is the member, is placed. Stand (10) is equipped with a heating function and a cooling function, whereby the substrate temperature can be controlled. Treating container (9) is made of a metal material such as an aluminum alloy, e.g., an Al-Mg alloy. An inner wall of treating container (9) is usually polished and then an oxidized passivated layer or a fluorinated passivated layer is formed thereon or coated with other materials such as $siO_2$, SiC or SiN so that its corrosion, contaminating substrate (11), due to exhaust of gas or separation of heavy metal from the wall or degradation of semiconductor devices caused thereby, are prevented.

In treating chamber (3), there is provided shower head (12) opposite to the face of stand (10) whereby plural gases are mixed and supplied. This shower head (12) is connected to gas supplying means (13) for supplying plural process gases to be used for the surface treating of substrate (11) via a pipe having opening/shutting valve (14). Incidentally, the plural gases used here mean gases comprising hydrogen peroxide and water.

In FIG. 12, only one shower head (12) and one gas-supplying means (13) are illustrated although, usually, these are installed in plural. In that case, a different type of process gas is supplied from each of gas-supplying means (13) to shower head (12) at a desired flow rate. For example, it is possible to control the flow rate so as to make the molar ratio of hydrogen peroxide to water near the surface of substrate (11) 1:3. Each of hydrogen peroxide and water may be supplied separately or as a mixed gas thereof. Further, those gases may be diluted with other gases. Examples of such other gases are those having 60 or less vibrational degree of freedom, such as rare gas, nitrogen and oxygen.

At the bottom of treating container (9), there is provided exhaust opening (15). Treating container (9) is connected to exhaust (16), such as a combination of rotary pump and turbo molecular pump via exhaust opening (15). Exhaust (16) exhausts the gas containing hydrogen peroxide, the gas containing water or the gas containing hydrogen peroxide and water in treating container (9) to a predetermined degree of partial pressures such as from 1013 hPa (millibar) to $1\times10^{-8}$ hPa.

Incidentally, when treatment by plasma assist, such as dry cleaning treatment, etching treatment, film-formation treatment, oxidation treatment or thermal annealing treatment, is carried out in treating chamber (3), treating container (9) is constituted in such a manner that it is electrically grounded. Stand (10) is used as a lower electrode where a high frequency electric field of 100 kHz–500 kHz, for example, is applied via a matching circuit, and shower head (12) is used as an upper electrode where a high frequency electric field of 15 GHz with a generating output of 0.3 to three kW is applied via a matching circuit.

It is preferred that the microwave frequency be three GHz or more when the fact that the frequency necessary for making a water cluster consisting of three or less molecules is 3.4 GHz or more, and the frequency necessary for making a hydrogen peroxide cluster consisting of two or less molecules is 3.2 GHz or more, is taken into consideration.

Further, in order to supply a gas containing hydrogen peroxide and water, gas supplied from a line wherefrom the vapor from an azeotropic mixture of hydrogen peroxide and water is supplied with a diluted carrier gas and another gas from a line wherefrom only steam is supplied, may be used, whereby the molar ratio of hydrogen peroxide to water at the position of semiconductor substrate (11) is adjusted to 1:3.

Treating chamber (3) constituted as such and connecting load lock chamber (4) are provided in a connectable manner by gate valve (5), which automatically opens when substrate (11) is carried in.

Load lock chamber (4) is in an air-tight structure and, in its inside, there is provided conveyer (17) which conveys substrate (11) and places substrate (11) onto stand (10) on adjacent treating chamber (3). Conveyer (17) is sealed to the bottom of load lock chamber (4) by a magnetic rail and is connected to driver (18) located outside by means of a driving axis which is capable of rotating, moving up and down, and X- and Y-axis-driving. Conveyer (17) is able to move forward, backward, and rotatively up-and-down by means of driving force of driver (18).

This is done in such a manner that inert gas such as nitrogen and argon or clean air is supplied into load lock chamber (4) from gas supplier (19) installed outside via opening/shutting valve (20) through filter (21) equipped in load lock chamber (4). Filter (21) may have many fine pores, the same as those in the shower head for gas, or may be a porous substance made into fine sintered product.

At the bottom of load lock chamber (4), there is provided exhaust (2) such as a turbomolecular pump and a rotary pump via exhaust opening (22) and valve (23). By this exhaust (24), load lock chamber (4) is exhausted from atmospheric pressure to a predetermined degree of vacuum such as from several tens of hPa to $1\times10^{-5}$ hPa.

Treating container (50) of load lock chamber (4) is made of metal material such as aluminum alloy (e.g. Al-Mg alloy). An inner wall of treating container (50) is usually polished and then an oxidized passivated layer or a fluorinated passivated layer is formed thereon or coated with other materials such as $SiO_2$, SiC or SiN, so that its corrosion, release of gas from the wall, and separation of heavy metal from the wall, are prevented.

Load lock chamber (4), constituted as above, and joint (7) are installed in a connectable manner via gate valve (6) and, in joint (7), receiving container (2) is installed in a connectable manner.

In gate valve (6) installed at the side wall of load lock chamber (4), joint (7) is installed, which is a path being able to join door (8) installed at receiving container (2). In this joint (7), a space is installed as a path whereby conveyer (17) in load lock chamber (4) is able to carry and convey substrate (11). Joint (7) is constituted in an air-tight manner so that a connecting-through space is formed to receiving chamber (2) by opening gate valve (6), and door (8) is isolated from outside whereby an air-tight clean space is formed. This joint (7) is constituted in such a manner that inert gas, such as nitrogen and argon, or clean air is supplied. The immobile part of joint (7) is made for a metal material, such as an aluminum alloy, e.g. an Al-Mg alloy. An inner wall of joint (7) is usually polished and then an oxidized passivated layer or a fluorinated passivated layer is formed thereon or coated with other materials such as $Sio_2$, SiC or SiN.

Receiving container (2) has an air-tight structure and, in its inner side, cassette (25), which is able to receive plural substrates (11) and holder (26) to hold them, are provided. Receiving container (2), cassette (25), and holder (26) are made of a metal material such as aluminum alloy, e.g. an Al-Mg alloy. An inner wall of them and surface of jig are usually polished and then an oxidized passivated layer or a fluorinated passivated layer is formed thereon or coated with other materials, such as $SiO_2$, SiC, or SiN, so that their corrosion, release of gas, or separation of heavy metal, are prevented.

On a side wall of receiving container (2), such as a side wall surface, door (8) is provided which is able to be opened and closed and has an air-tight function in a closed state. Receiving container (2) is in such a structure that, being separated from semiconductor treating apparatus (1), it is able to convey, keeping the inner atmosphere and cleanliness. In receiving container (2), it may be either in an ordinary pressure (around 1013 hPa) filled with inert gas, such as nitrogen and argon, or clean air, or in a reduced pressure state by such a gas during the conveyance of container (2).

On the upper part of receiving container (2), opening/shutting valve (28), having opening (27) is connected to filter (29) in receiving container (2) by a pipe. Opening/shutting valve (28) is opened only when inert gas, such as nitrogen and argon, or clean air, is supplied into receiving container (2) by an outer gas-supplying means such as gas-supplier (19). At the lower part of receiving container (2), valve (31) is connected via exhaust opening (30) and valve (31) has opening (32). Valve (31) is opened only when receiving container (2) is vacuum exhausted. The vacuum exhaustion is constituted in such a manner that it takes place when an exhaust independently installed outside, such as exhaust (24), is connected to opening (32).

Operation of this receiving container (2) will be explained. Door (8) of receiving container (2), which receives plural untreated substrates (11), is closed to give an air-tight state. The inner part of receiving container (2) is exhausted to an extent of desired degree of vacuum and inert gas, such as nitrogen and argon, or clean air is introduced thereinto, so as to maintain a predetermined degree of vacuum.

Operation of the conveying system for substrate (11) constituted as above will be explained. Receiving container (2) having cassette (25) wherein plural substrates (11) are received, is conveyed by an automatic conveying robot keeping its inner degree of cleanliness at class 1, for example, by closing door (8) and then being located next to joint (7) installed adjacent to load lock chamber (4) of semiconductor treating apparatus (1).

The atmosphere in load lock chamber (4) is vacuum exhausted by exhaust (24), opening/closing valve (23) is closed, and then inert gas, such as nitrogen and argon, or clean air, is supplied into load lock chamber (4) from gas-supplying means (19) until the predetermined pressure is achieved. Gate valve (6) and door (8) are opened, load lock chamber (4) and receiving container (2) are connected, and the inner part is made an atmosphere of a common inert gas, such as nitrogen and argon, or clean air. After that, conveyer (17) in load lock chamber (4) moves and substrates (11) are taken out from cassette (25) in receiving container (2) and conveyed into load lock chamber (4).

Then, gate valve (6) is closed and the inside of load lock chamber (4) is vacuum exhausted to a predetermined degree of vacuum, such as $1\times10^{-3}$ hPa. After that, gate valve (5) is opened and substrates (11) held by conveyer (15) are transferred onto stand (10) in treating chamber (3).

After conveyer (17) moves into load lock chamber (4), the gate valve is closed and the inside of treating chamber (3) is vacuum exhausted to a predetermined degree of vacuum. Then, predetermined processes, such as supplying of process gas into treating chamber (3), heating, and generation of plasma are carried out to substrates (11).

The inside of treating chamber (3), after completion of the processes, is vacuum exhausted and substituted with atmosphere of inert gas, such as nitrogen and argon, or clean air, and gate valve (5) is opened and substrates (11) are conveyed out into load lock chamber (4) by conveyer (17).

Then gate valve (5) is closed, the inside of load lock chamber (4) is substituted with atmosphere of inert gas, such as nitrogen and argon, or clean air, gate valve (5) is opened, and substrates (11) are returned to the predetermined slot of cassette (25) hold in receiving container (2). The conveying system for substrate (11) works as such and, when such an operation is repeated by taking out from cassette (25) every single-wafer, the treatment for all substrates (11) in cassette (25) is carried out.

When such a series of treatment is finished, gate valve (6) is closed, semiconductor treating apparatus (1) is returned to an air-tight state and, at the same time, door (8) of receiving container (2) is closed whereupon receiving container (2) is kept in an air-tight atmosphere of inert gas, such as nitrogen and argon, or clean air.

After that, receiving container (2), in which plural treated substrates (11) are received, is conveyed to the semiconductor manufacturing apparatus or a semiconductor testing apparatus of the next step, keeping the atmosphere of inert gas, such as nitrogen and argon, or clean air.

Except when the treatment for the semiconductor substrate is carried out, the conveying system for the substrate, which is operated as above, is always kept in an atmosphere of inert gas, such as nitrogen and argon, or clean air. As a result, the substrate can be protected from trash, dust, and contamination from an outer environment throughout all the process steps and, in addition, it is possible to carry out a series of treatments where conveying of the substrate having an effect of shielding the heavy metal contamination can be carried out.

In a surface treating system shown by FIG. 12, only one treating chamber (3) is connected to load lock chamber (4), although a system where plural treating chambers (3) are connected to load lock chamber (4) for carrying out plural kinds of treatments are successively carried out to the semiconductor substrate, may be acceptable as well. Further, the pressure in receiving container (2) may be set at that which is optimum for the treatment and, for example, it can be made vacuum exhausted by an inert gas, such as nitrogen and argon, or clean air, to make it as same as the pressure in load lock chamber (4), such as $1\times10^{-3}$ hPa, which is to be connected and then conveyed.

On the contrary, it is also possible that the atmosphere of inert gas, such as nitrogen and argon, or clean air, is made higher than the atmospheric pressure, to prevent its contamination of outer air into receiving container (3) and, prior to connection to load lock chamber (4), receiving container (2) is atmosphere vented to make it near atmospheric pressure, followed by connecting to load lock chamber (4).

Although shower head (12) was used for supplying the process gas to treating container (9), it is also possible to install one or more supplying opening(s) in a form of a nozzle. In that case, it is necessary to install an upper electrode instead of shower head (12) for application of microwaves.

Further, in order to promote dissociation of oxywater, an irradiating function for an electromagnetic field, of energy 0.4 eV or more, may be installed in treating chamber (3).

The water for the treatment may be not only light water ($H_2O$) but also heavy water ($D_2O$ or HDO). Especially when heavy water is used, there is an improvement in electric reliability after carrying out various treatments for oxide films, such as suppression of interfacial states generation caused by hydrogen (H) under electric stress.

When a dry cleaning treatment for metal contamination, such as Al, Cu, Fe, or Ni is carried out, it is preferable to use not only a gas containing hydrogen peroxide and water, but also another gas together therewith. This utilizes the fact that, as a formation of metal oxide, the reactivity of metal with another gas, such as hydrogen fluoride, is enhanced.

For example, when a gas containing hydrogen peroxide and water, and a reactive gas containing halogen or a chelating agent forming a chelate compound with metal, are simultaneously, alternately, or continuously supplied to and treated in treating chamber (3), a metal compound having a relatively high vapor pressure, such as metal halide, metal halide oxide, metal chelate compound, and metal oxide chelate compound, is produced and, therefore, metal contamination can be removed. Examples of the halogen-containing reactive gas are anhydrous hydrogen fluoride, anhydrous hydrogen chloride, anhydrous hydrogen bromide, anhydrous hydrogen iodide, $F_2$, $Cl_2$, $Br_2$, $I_2$, $ClF_3$, $NF_3$, $BF_3$, $BCl_3$, $BBr_3$, $BI_3$, $CF_3Cl$, $CF_3Br$, and $CF_3I$. In view of prevention of ozone depletion, however, it is preferable to avoid the use of a gas containing Cl if at all possible.

When a metal compound having a high vapor pressure is hardly formed, such as in the case of Cu, it is preferred to carry out a physical removal means, such as to irradiate solid rare gas, solid carbon dioxide, solid alcohol, ice, or the like, to apply ultrasonic waves and/or to elevate the temperature. Especially when the above-mentioned metal compound formation and physical removal are repeated simultaneously, alternately, or continuously, once or more, it is possible to remove metal contamination, such as Cu. In case where ultrasonic vibration is applied, the transmission efficiency of the ultrasonic wave can be enhanced with vapor of an organic solvent, wherein vapor pressure under an ordinary state is significantly high and whereby drying of substrate (11) quickly proceeds. An example of such is isopropyl alcohol being supplied to treating chamber (3) followed by treating, or when treating chamber (3) is made in such a structure that substrate (11) is able to be dipped in a liquid solvent followed by treating.

Further, as mentioned already, in order to suppress the dispersion of endothermic energy generated by adsorption of water with hydrogen peroxide due to collision of molecules, it is first of all important that the total pressure in treating chamber (3) is low and the exhausting speed is high or, in other words, residence time of the process gas in treating chamber (3) is short. A second important point to consider is that the vibrational degree of freedom, 3N-6, (where N is the number of atoms constituting a gas molecule) of the gas used for dilution is small, or molecular weight of the gas used for dilution is large. The most preferred gas is a heavy rare gas (such as Kr and Xe) where the vibrational degree of freedom is zero, although a diatomic molecule, such as nitrogen or oxygen, where the vibrational degree of freedom is one is preferred as well. Alcohol, such as isopropyl alcohol, quickly dries away on substrate (11) and, therefore, it may be utilized as a gas for dilution, but its vibrational degree of freedom is 30. When the vibrational degree of freedom is 60 or less, such a substance, including an isopropyl alcohol dimer, can be utilized.

Examples of the present invention will now be mentioned.

EXAMPLE 1

According to a method as shown below, metal contamination on the surface of semiconductor substrate (11) was subjected to a dry cleaning treatment using a surface treating system shown in FIG. 12.

First, a p-type (100) silicon substrate (11) was dipped into a solution containing Fe, so that its surface was intentionally contaminated. When the initial contamination concentration was analyzed by means of a vapor phase analysis of flameless atomic absorption spectrometry, $1.5\times10^{15}$ atoms/cm$^2$ of Cu and $5\times10^{15}$ atoms/cm$^2$ of Fe were detected.

Substrate (11) was placed on stand (10) in treating chamber (3), mixed gas of hydrogen peroxide and water in a molar ratio of 1:3, and anhydrous hydrogen fluoride gas in the total pressure of 6.65 hPa were alternately introduced into treating chamber (3) and 15 GHz microwaves were applied to carry out a cleaning treatment at ambient temperature. Further, a step of irradiation of solid carbon dioxide onto the surface to be treated of substrate (11) was carried out for ten cycles where one cycle consisted of ten seconds.

After that, substrate (11) was removed, and the residual contamination concentration was determined, whereupon the contamination was removed to such an extent that only $7\times10^9$ atoms/cm$^2$ of Cu and $9\times10^9$ atoms/cm$^2$ of Fe were detected.

EXAMPLE 2

According to a method as shown below, organic contamination on the surface of semiconductor substrate (11) was subjected to a dry cleaning treatment using a surface treating system shown in FIG. 12.

First, a positive resist of a novolac type was spin-coated on the surface of silicon substrate (11). After substrate (11) was placed on stand (10) in treating chamber (3), mixed gas of hydrogen peroxide and water in a molar ratio of 1:3 having total pressure of 6.65 hPa were introduced into treating chamber (3), and 15 GHz microwaves were applied to carry out a cleaning treatment at ambient temperature. This cleaning treatment step was carried out for from one to 150 cycle(s), where one cycle consisted of three seconds.

After that, substrate (11) was taken out from treating chamber (3) and the resist removal rate was measured. The resist removal rate was 600 nm/min.

Then, a positive resist of a novolac type was spin-coated on above-treated silicon substrate (11). Substrate (11) was placed on stand (10) in treating chamber (3), hydrogen peroxide gas and steam were alternately introduced into treating chamber (3) to make their molar ratio 1:3 with a total pressure of 6.65 hPa, and a cleaning treatment was carried out under ultraviolet-ray irradiation from a low voltage mercury lamp, together with application of 15 GHz microwaves at ambient temperature. This cleaning treatment step was carried out for five cycles where one cycle consisted of three seconds.

After that, substrate (11) was removed and the residual organic contamination was measured. The carbon residual contamination concentration can be removed to the detection limit or less upon measurement by an X-ray photoelectron spectroscopic method.

EXAMPLE 3

According to a method as shown below, particle removal was carried out by applying a dry cleaning treatment onto the surface of semiconductor substrate (11) using a surface treating system shown in FIG. 12.

First, fine particles of polystyrene were sprinkled onto the surface of silicon substrate (11) so that the surface was intentionally contaminated. After substrate (11) was placed on stand (10) in treating chamber (3), a mixed gas of hydrogen peroxide and water in a molar ratio of 1:3 with a total pressure of 6.65 hPa was introduced into treating chamber (3) and 15 GHz microwaves were applied to carry out a cleaning treatment at ambient temperature. This cleaning treatment step was carried out for one to 50 cycle(s), where one cycle consisted of three seconds.

After that, substrate (11) was removed and the removal rate of the particles having 0.1 micron in diameter or more was measured. Organic contamination forming a glue layer adhering the particles to substrate (11) was easily oxidized and removed by an oxidizing species derived from hydrogen peroxide and, unlike the liquid phase step, charge of the particles was suppressed and, accordingly, even by a treatment of about ten cycles, a particle removal rate of 98% or more was able to be achieved. When fine particles of silica or fine particles of silicon nitride were sprinkled instead of polystyrene, a particle removal rate of 97% or more can be achieved as well, under the same conditions.

EXAMPLE 4

According to a method as shown below, a silicon oxide film was formed on the surface of semiconductor substrate (11) using a surface treating system shown in FIG. 12.

First, silicon substrate (11) wherefrom the native oxide film was removed was placed on stand (10) in treating chamber (3). Then, a mixed gas of hydrogen peroxide and water in a molar ratio of 1:3 was introduced into treating chamber (3) having a total pressure of 6.65 hPa, 15 GHz microwaves were applied and an oxidation treatment was carried out at 600° C. for 500 minutes.

After that, substrate (11) was removed and characterization of the formed silicon oxide film was carried out. The refractive index was 1.46, thickness of the oxide film was four nm, interfacial states density was $1\times10^{10}/cm^2$, leak current upon application five 5 MV/cm was $2\times10^{-10}$ A/cm$^2$ and defect density as measured by an electron spin resonance method was not more than the detection limit for all of E' center, Pb center, peroxy radical, and non-bridging oxygen hole center. Thus, the same or more electrical properties were achieved as compared with the oxide film formed by the use of conventional dry oxide film or reactive oxygen such as oxygen atom and its exited states.

EXAMPLE 5

According to a method as shown below, the so-called pretreatment, i.e. a dry cleaning treatment, and a silicon oxide film forming treatment, was sequentially carried out using a surface treating system shown in FIG. 12. Incidentally, this dry cleaning treatment is to remove the metal contamination, organic contamination and particles on the surface of substrate (11).

First, silicon substrate (11) wherefrom the native oxide film was removed was placed on stand (10) in treating chamber (3). Then, a mixed gas of hydrogen peroxide and water in a molar ratio of 1:3 was introduced into the treating chamber (3) having total pressure of 6.65 hPa, and a cleaning treatment was carried out, where ultraviolet ray irradiation from a low-voltage mercury lamp was applied together with application of 15 GHz microwaves at ambient temperature. This cleaning treatment step was carried out for five cycles, where each cycle consisted of three minutes.

Then, a mixed gas of hydrogen peroxide and water in a molar ratio of 1:3 and anhydrous hydrogen fluoride were alternately introduced thereinto having a total pressure of 6.65 hPa, a cleaning treatment was carried out by applying 15 GHz microwaves at ambient temperature and then solid isopropyl alcohol was irradiated to substrate (11). Such a cycle was carried out for ten cycles, wherein one cycle consisted of ten seconds.

Further, a mixed gas of hydrogen peroxide and water in a molar ratio of 1:3 was introduced into treating chamber (3) having a total pressure of 6.65 hPa, 15 GHz microwaves were applied and an oxidation treatment was carried out at 600° C. for 500 minutes.

After that, substrate (11) was taken out and the characterization of the formed silicon oxide film was carried out. The refractive index was 1.46, thickness of the oxide film was four nm, interfacial states density was $9\times10^9/cm^2$, leakage current at five MV/cm was $1\times10^{-}10$ A/cm$^2$, and defect density as measured by an electron spin resonance method was not more than the detection limit for all of E' center, Pb center, peroxy radical, and non-bridging oxygen hole center. Thus, the same or more electrical properties were achieved as compared with the oxide film formed by the use of conventional dry oxide film or reactive oxygen, such as an oxygen atom, and its exited states, and also as compared with the case of Example 4, where a silicon oxide film forming treatment was solely carried out. Incidentally, this sequential treatment may be carried out in the same treating chamber or by conveying substrate (11) to be treated to another treating chamber or to another treating apparatus.

EXAMPLE 6

According to a method as shown below, a silicon oxide film forming treatment using heavy water was carried out using a surface treating system shown in FIG. 12.

First, silicon substrate (11) wherefrom the native oxide film was removed was placed on stand (10) in treating chamber (3). Then, a mixed gas of hydrogen peroxide and heavy water ($D_2O$) in a molar ratio of 1:3 was introduced into treating chamber (3), having a total pressure of 6.65 hPa, and an oxidation treatment was carried out by application of 15 GHz microwaves at 600° C. for 500 minutes.

After that, substrate (11) was taken out and the characterization of the formed silicon oxide film was carried out. Regarding an oxide film as grown, concentration of the contained heavy water was $1\times10^{19}$ atoms/cm$^2$, refractive index was 1.46, thickness of the oxide film was four run, interfacial states density was $1\times10^{10}/cm^2$, leakage current at five MV/cm was $2\times10^{-10}$ A/cm$^2$ and defect density as measured by an electron spin resonance method was not more than the detection limit for all of E' center, Pb center, peroxy radical, and non-bridging oxygen holecenter. Thus, the same result as in Example 4, where light water ($H_2o$) was used, was achieved.

However, an increase in the interfacial states density after application of an F–N stress up to ten C/cm$^2$ under the charge injection condition of Jg=–0.01 A/cm$^2$ was suppressed to an extent of about 60%, as compared to Example 4. In addition, dispersion of the interfacial states density after application of an F-N stress was significantly decreased, as compared to the case of light water.

EXAMPLE 7

According to a method as shown below, a thermal treatment of a metal oxide was carried out using a surface treating system shown in FIG. 12.

First, a thermodynamically stable $SrTiO_3$ layer was formed on a TiAlN barrier layer made on one of the main surfaces of silicon substrate (11), and then a metal oxide film capacitor was formed having a structure of $SrRuO_3/BaTiO_3/SrRuO_3$.

After that, silicon substrate (11) was placed on stand (10) in treating chamber (3). Further, a mixed gas of hydrogen peroxide and water in a molar ratio of 1:3 was introduced into treating chamber (3) having a total pressure of 6.65 hPa, 15 GHz microwaves were applied, and an oxidizing treatment was carried out at 600° C. for 90 minutes.

In this oxidizing treatment, neither film peeling nor swelling that occurs in a vacuum thermal treatment was noted. The c-axis length of the $BaTiO_3$ ferroelectric layer, as measured by an X-ray diffraction method, showed an elongation of as long as 0.414 nm. The ferroelectric characteristic was as good as 60 $mC/cm^2$ when the ferroelectric film thickness was about 30 nm and applied voltage was 1 V. In addition, the squareness ratio of hysteresis was improved, whereby an operation under lower voltage was possible. Further, an imprint in the initial state was less than the case where the electrode was sandwiched with platinum and a vacuum thermal treatment was carried out at $1.33\times10^{-6}$ hPa.

EXAMPLE 8

According to a method as shown below, a chemical vapor-phase deposition (CVD) treatment of a fluorine-added silicon oxide film was carried out using a surface treating system shown in FIG. 12.

First, silicon substrate (11) wherefrom the native oxide film was removed was placed on stand (10) in treating chamber (3), and a mixed gas of hydrogen peroxide and water in a molar ratio of 1:3, $SiF_4$ gas, and $SiH_4$ gas, were introduced into treating chamber (3) at the flow rates of 500 $cm^3$/minute, 50 $cm^3$/minute, and 20 $cm^3$/minute, respectively, until the total pressure became 6.65 hPa, 15 GHz and 13.56 GHz microwaves were applied to the upper electrodes, while an RF bias of 13.56 MHz was applied to the lower electrode at 470° C., to form a fluorine-added silicon oxide film.

After that, substrate (11) was taken out and the characteristics of the resulting fluorine-added silicon oxide film were investigated. The fluorine-added silicon oxide film was a low-dielectric film where fluorine concentration was 12 at %, refractive index was 1.36, and dielectric constant was 3.4. After substrate (11) was exposed for one week to an atmospheric environment in a clean room, neither $H_2O$ nor Si-OH were detected by FT-IR, SIMS, and TDS measurement. It was possible to form a low dielectric fluorine-added silicon oxide film having good moisture resistance.

Regarding a defect density measured by an electron spin resonance method, E' center was $3\times10^{16}/cm^3$ and the defect assigned as peroxy radical and non-bridging oxygen hole center was $1\times10^{16}/cm^3$, which were found to be smaller than the conventional plasma CVD oxide film. Incidentally, unless fluorine-containing gas such as $SiF_4$ is introduced, a normal silicon oxide film is formed. In addition, TEOS ($Si(OC_2H_5)_4$) and a fluorinated gas thereof ($SiF_n(OC_2H_5)_{4-n}$, n=1–3), fluorinated silane gas ($SiF_nH_{4-n}$), etc., used for formation of fluorine-containing silicon oxide film and silicon oxide film, may be used as well.

As illustrated hereinabove, in the present invention, a cluster where the first and the second molecules are bonded by means of an intermolecular force is formed and, therefore, it is possible that first molecule is made more reactive in a very efficient manner. Accordingly, in accordance with the present invention, a surface treating at a sufficient processing rate is possible. Further, in the present invention, hydrogen oxide molecules and water molecules, for example, can be used as the first and the second molecules, respectively, and the surface of the member can be treated using oxywater. Thus, according to the method of the present invention, it is possible to carry out a surface treatment using chemical substances that need no additional environmental management even if exhausted into environment. Furthermore, in the present invention, the surface treating of the member is carried out in a gas phase. Thus, unlike the case of carrying it out in a liquid phase, the surface treating can be done without the use of a large amount of pure water as a solvent or a rinse agent.

Thus, in accordance with the present invention, there is provided a surface treating method with a small environmental load. Further, there is provided a surface treating method in which a surface treatment is possible that has a sufficient processing rate. Furthermore, there is provided a surface treating method in which a surface treating is possible without the use of a large amounts of pure water.

What is claimed is:

1. A surface treating method for treating a surface of a member, comprising:

producing a cluster having a first molecule and a second molecule bonded together by an intermolecular force in a gas vapor phase, making the first molecule more reactive than the first molecule in a case of being not bonded with the second molecule by utilizing at least a part of internal energy released in producing the cluster; and treating the surface of the member in a gas phase with the cluster containing the first molecule made in a state of higher reactivity, wherein:

an electromagnetic field irradiates the cluster containing the first molecule made in the state of higher reactivity.

2. The surface treating method according to claim 1, wherein the energy of the electromagnetic field is 0.4 eV or more.

3. A surface treating method for treating a surface of a member, comprising:

producing a cluster having a first molecule and a second molecule bonded together by an intermolecular force in a gas vapor phase, making the first molecule more reactive than the first molecule in a case of being not bonded with the second molecule by utilizing at least a part of internal energy released in producing the cluster; and treating the surface of the member in a gas phase with the cluster containing the first molecule made in a state of higher reactivity, wherein:

a position making the first molecule higher in reactivity is near the surface of the member.

4. A surface treating method for treating a surface of a member, comprising:

producing a cluster having a first molecule and a second molecule bonded together by an intermolecular force in a gas vapor phase, making the first molecule more reactive than the first molecule in a case of being not bonded with the second molecule by utilizing at least a part of internal energy released in producing the cluster; and treating the surface of the member in a gas phase with the cluster containing the first molecule made in a state of higher reactivity, wherein:

the first and the second molecules are supplied to the surface of the member as a gas, which contains the first molecule, and a gas, which contains the second molecule, or as a mixed gas, which contains both the first and the second molecules, and a microwave is applied to at least one of the gas which contains the first molecule, the gas which contains the second molecule, and the mixed gas which contains both the first and the second molecules.

5. The surface treating method according to claim 4, wherein the frequency of the microwave is 3 GHz or more.

6. The surface treating method according to claim 4, wherein at least one of the gas which contains the first molecule, the gas which contains the second molecule, and the mixed gas which contains both the first and the second molecules, is a gas consisting of molecules having vibrational degrees of freedom of 60 or less.

7. A surface treating method for treating a surface of a member, comprising:

producing a cluster having a first molecule and a second molecule bonded together by an intermolecular force in a gas vapor phase, making the first molecule more reactive than the first molecule in a case of being not bonded with the second molecule by utilizing at least a part of internal energy released in producing the cluster;

treating the surface of the member in a gas phase with the cluster containing the first molecule made in a state of higher reactivity, wherein:

the treating of the surface of the member with the cluster includes oxidizing the surface of the member or contamination that is adhered to the surface of the member, the method further comprising:

treating the surface of the member using any of a gas having reactivity with an oxide, or a chelating agent forming a chelate compound with metals, which are adhered to the surface of the member, after or together with treating the surface of the member with the duster.

8. A surface treating method for treating a surface of a member, comprising:

producing a cluster having a first molecule and a second molecule bonded together by an intermolecular force in a gas vapor phase, making the first molecule more reactive than the first molecule in a case of being not bonded with the second molecule by utilizing at least a part of internal energy released in producing the cluster;

treating the surface of the member in a gas phase with the cluster containing the first molecule made in a state of higher reactivity; and physically removing a residual product produced on the surface of the member by treating the surface of the member with the cluster.

9. A surface treating method for treating a surface of a member; comprising:

producing a cluster having a first molecule and a second molecule bonded together by an intermolecular force in a gas vapor phase, making the first molecule more reactive than the first molecule in a case of being not bonded with the second molecule by utilizing at least a part of internal energy released in producing the cluster; and treating the surface of the member in a gas phase with the cluster containing the first molecule made in a state of higher reactivity, wherein:

the member is a semiconductor substrate and treating the surface of the semiconductor substrate with the cluster is at least one step selected from a group consisting of a step of cleaning the surface of the semiconductor substrate, a step of forming an oxide film, which contains silicon, on the surface of the semiconductor substrate, a step of forming an oxide film, which contains metals, on the surface of the semiconductor substrate, a step of oxidizing a film on the surface of the semiconductor substrate, a step of forming a film by a chemical vapor phase deposition on the surface of the semiconductor substrate, a step of forming a film by a physical vapor phase deposition on the surface of the semiconductor substrate, a step of thermal treatment of the surface of the semiconductor substrate and a step of dry etching of the surface of the semiconductor substrate.

* * * * *